United States Patent [19]

Bowers et al.

[11] Patent Number: 4,505,092

[45] Date of Patent: Mar. 19, 1985

[54] PACKAGE SENSING/FILM CONTROL SYSTEM FOR FILM WRAPPING MACHINE

[75] Inventors: Russell E. Bowers, Trotwood; Fritz F. Trieber, Centerville, both of Ohio

[73] Assignee: Hobart Corporation, Troy, Ohio

[21] Appl. No.: 371,707

[22] Filed: Apr. 26, 1982

[51] Int. Cl.[3] ..... G01G 23/38

[52] U.S. Cl. ..... 53/504; 53/66; 53/168; 53/441; 53/556

[58] Field of Search ..... 53/66, 64, 556, 441, 53/168, 389, 503, 504

[56] References Cited

U.S. PATENT DOCUMENTS

| | | | |
|---|---|---|---|
| 2,227,398 | 12/1940 | Mohl | 53/66 |
| 3,029,571 | 4/1962 | Douthit . | |
| 3,182,539 | 5/1965 | Williams, Jr. | 53/66 X |
| 3,662,513 | 5/1972 | Fabbri . | |
| 3,967,433 | 7/1976 | Bonfiglioli . | |
| 4,075,815 | 2/1978 | Carver, Jr. et al. . | |
| 4,134,246 | 1/1979 | Michels . | |
| 4,180,962 | 1/1980 | Michels . | |
| 4,205,501 | 6/1980 | Michels . | |
| 4,341,586 | 7/1982 | Koutonen | 53/389 X |

OTHER PUBLICATIONS

Brochure entitled "Weldotron Automac Stretch Packaging System".

*Primary Examiner*—James F. Coan

*Attorney, Agent, or Firm*—Biebel, French & Nauman

[57] ABSTRACT

A package sensing system provides length, width and height signals to a film control system which selects the width and length of stretch film to be used by a film wrapping machine to wrap the sensed package. Package width is sensed by spring biased swing arms which active electrical switches upon deflection by an entering package. A wide package is indicated if both swing arms are deflected. The length and height of a package are sensed by a generally vertical downwardly extending lever arm which is pivotally mounted above the package entryway into the machine. A first electrical switch coupled to the lever arm generates a length signal upon initial contact by an entering package and a second electrical switch coupled to the lever arm generates a height signal depending upon the ultimate deflection of the lever arm by the package. Two film widths are provided with the narrower of the two being selected for packages which activate neither the width sensing system or the height sensing system and the wider of the two films being selected upon activation of either of those sensing systems. The length of the film drawn is determined by the length of a measured package with that length being incrementally increased if a high package is sensed.

18 Claims, 21 Drawing Figures

PACKAGE SENSING/FILM CONTROL SYSTEM FOR FILM WRAPPING MACHINE

CROSS-REFERENCE TO RELATED APPLICATIONS

This application is related to the following U.S. patent applications which were concurrently filed herewith and are assigned to the same assignee as the present application: application entitled FILM WRAPPING MACHINE INCLUDING FILM LENGTH SELECTION, filed by Raymond J. Mathieu; application entitled WRAPPING CONTROL SYSTEM FOR FILM WRAPPING MACHINE, filed by Fritz F. Treiber and Russell E. Bowers; application entitled JAM DETECTION AND REMOVAL FOR WRAPPING MACHINE, filed by Fritz F. Treiber; application entitled FILM AND PACKAGE HANDLING APPARATUS FOR WRAPPING MACHINE, filed by Fritz F. Treiber; and application entitled FILM SUPPLY MONITOR FOR FILM WRAPPING MACHINE, filed by Robert M. Rogers, Fritz F. Treiber and Russell E. Bowers.

BACKGROUND OF THE INVENTION

This invention relates generally to package wrapping machine utilizing thin, stretchable film to wrap and display articles contained in trays and, more particularly, to an improved package sensing system for generating signals representative of the size characteristics of packages to be wrapped and a film control system for selecting the width and length of a section of stretchable film to wrap a sensed package in response to such signals.

A variety of film wrapping machines are known in the prior art. One commercially available machine includes a package sensing system which determines the length and the width of a package to be wrapped. Based on the sensed length and width characteristics, the wrapping machine selects one of two differing width film rolls and the length of the film sheet drawn from the selected roll.

Herein, the length of a package refers to the dimension of the package as it is fed into a wrapping machine and the width of the package refers to the dimension of the package perpendicular to the feed of the package into the machine. Thus, when referring to the length and width of a package, the "width" of the package is normally longer than its "length".

In the known commercially available wrapping machine, the length of the package is determined by a first sensor located in the surface of a package feed-in tray and approximately on the center line thereof. The first sensor is utilized to determine the length of a package by fixing the time when the package contacts the sensor relative to the phase of the machine cycle. The width of the package is determined by means of a second sensor similarly located in the surface of the feed-in tray but offset from the center line of the tray by a defined distance. If the second sensor is activated, it is presumed that a wide package has been fed into the machine.

While this wrapping machine is an improvement over earlier prior art machines which utilize a fixed length of a single width film to wrap all packages regardless of size (see for example, U.S. Pat. Nos. 3,662,513 and 3,967,433), the sensing system is limited. To partially overcome the sensing system limitations, a separate mechanical package centering device is provided. This device adds cost to the machine and in the event it is disabled or malfunctions, the centering system may produce erroneous readings. In particular, if an operator inadvertently places a package off center toward the second sensor in the feed-in tray, a narrow package could engage the second, wide package sensor and erroneously indicate that a wide package was to be wrapped with the wider of the two differing width films.

In the event of such an error, the machine should still wrap the package, however, the wrap would be inefficient in terms of film usage and could create bulky, unattractive packages. On the other hand, if a wide package was inadvertently placed toward the side of the feed-in tray away from the wide package sensor, a wide package could be wrapped with narrow film. In this case, the package would probably be inadequately wrapped. Such errors could require rewrapping of packages and could result in contamination or jamming of the machine with resultant down time. Furthermore, the package sensing system of the known wrapping machine only senses the length and width of packages to be wrapped.

It is, thus, apparent that the need exists for an improved package sensing system for measuring the size characteristics of packages to be wrapped and a film control system for selecting the width and length of film to be used to wrap sensed packages. The film width and length to be used for wrapping a given package can then be more accurately selected to improve the wrapping characteristics and efficiency of the film wrapping machine.

SUMMARY OF THE INVENTION

In accordance with the present invention, an improved package sensing system generates length, width and height signals for use by a film control system to select the width and length of film to be used by a film wrapping machine for wrapping the package. The width of a package to be wrapped is measured by lateral sensing means comprising first sensing means on one side of the package entryway to the machine and second sensing means on the opposite side of the package entryway. Packages to be wrapped will engage neither, one or both of the first and second sensing means upon entering the machine. If neither or one of the first and second sensing means are actuated, a "narrow" package is indicated, but if both the first and second sensing means are actuated, a "wide" package is indicated.

The length of a package is measured in accordance with the present invention by longitudinal sensing means which comprises a lever arm pivotally mounted above the package entryway to the machine. The lever arm extends in an approximately vertical orientation downwardly into the package entryway. At least one electrical switch is coupled to the lever arm so that a length signal is generated upon contact of the lever arm by an entering package. The pivotally mounted lever arm of the longitudinal sensing means also provides for the generation of height signals in that the vertical sensing means comprises at least one electrical switch coupled to the lever arm for generating such height signals.

In a preferred embodiment of the package sensing system of the present invention, the lateral sensing means not only provides for sensing the width of packages as they enter the machine to be wrapped, but also assists in centering packages entering the machine. This preferred embodiment of the lateral sensing means comprises a pair of pivotally mounted swing arms which extend into the package entryway to the machine. The swing arms are slanted into the machine to increase the package centering characteristics.

Resilient means are provided for biasing the swing arms into the package entryway with the resilient means being of sufficient resiliency to yield under the force of an entering package, yet exert a force tending to center packages between the swing arms. At least one electrical switch is coupled to each swing arm and such electrical switches are utilized to generate a wide package signal upon a defined deflection of both swing arms by an entering package.

To prevent contact bounce which can lead to the generation of inaccurate signals by the sensing system, the electrical switches preferrably comprise Hall effect switches.

The film control system utilizes the measured length of a package to select a length of film for wrapping the package. If the package is in excess of a predetermined height dimension, i.e., a "high" package, a longer section of film is drawn. Two film widths are provided with the wider of the two being selected for high packages. Hence, both the width and the length of film for wrapping a package are selected in response to the measured height of the package. The film control system also selects the wider of the two film widths if the measured width of the package exceeds a predetermined width, i.e., a wide package is sensed.

The disclosed package sensing and film control system permits a novel method of selecting the size of a sheet of film or wrapping material to be used for wrapping a package. As the package is transported to a wrapping station, the package length and height dimensions are measured. A high package is indicated if the height is beyond a predetermined height dimension. A continuous supply or source of wrapping material wider than the package is provided and has a leading edge positioned at a defined material pulling location. The leading edge of the wrapping material is pulled to a first location dependent upon the length of the package if the height does not exceed the predetermined height dimension. If the measured package height exceeds the predetermined height dimension, the material leading edge is pulled to a second location beyond the first location to provide a longer material length for wrapping the package.

In accordance with the film size selection method, two differing width wrapping materials can be provided with the wider material being selected for wrapping packages which exceed the predetermined height. The wider material is also selected for wide packages.

A novel method for wrapping packages is also disclosed in the present application. In the method, a package is transported to an elevator platform and the length and height characteristics of the package are measured during transit. A continuous source of stretch film is provided with a leading edge positioned above the elevator so that sheets of the film can be drawn horizontally over the elevator. The film is drawn to a first location if the package height does not exceed a predetermined height and to a second location beyond the first location if the predetermined height is exceeded. The film is severed from the source to form a sheet into which the package is elevated. The film is then tucked beneath the package and sealed to complete the wrapping operation.

In accordance with the wrapping method, two differing width film sources can be provided with the wider film being selected for wrapping packages which exceed the predetermined height. Thus, in this method, film length and width are selected in accordance with the package height. Wide film is also selected to wrap wide packages.

It is, therefore, an object of the present invention to provide an improved package sensing system for generating length, width and height signals to be used by a wrapping machine in selecting the width and length of a section of film or other wrapping material to be used to wrap a sensed package; to provide an improved package sensing system wherein length and height signals are generated by the same sensing lever arm which is pivotally mounted and extends downwardly into the package entryway; to provide an improved package sensing system wherein lateral sensing means assists in centering packages entering the machine; to provide a method for selecting the length of wrapping material in accordance with measured package length with an increase in material length for packages higher than a predetermined height; to provide a method for selecting the wider of two widths of wrapping material for packages greater in height than a predetermined height or greater in width than a predetermined width; to provide a method for wrapping packages in stretch film wherein greater lengths of material are drawn for packages higher than a predetermined height; and to provide a method for wrapping packages in stretch film wherein both the width and length of the film are selected in accordance with package height.

Other objects and advantages of the present invention will be apparent from the following description, the accompanying drawings and the appended claims.

DETAILED DESCRIPTION OF THE INVENTION

I. Overview of Wrapping Machine Operation

Figure 1:
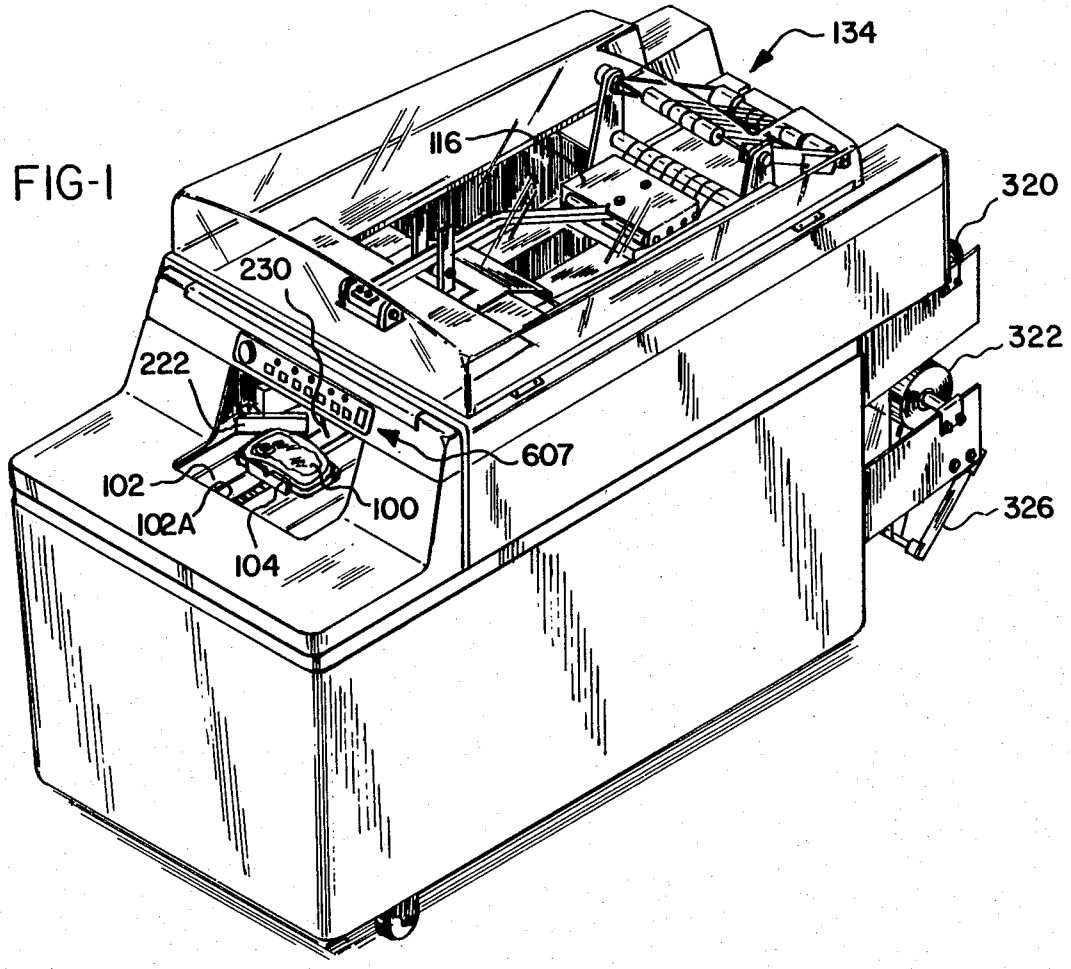
FIG. 1 is a perspective view of a stretch film wrapping machine embodying the invention of the present application.

FIG. 1 is a perspective view of a film wrapping machine incorporating a variety of novel improvements in the film wrapping art. As an overview, the general operation of the film wrapping machine will be described for wrapping a package 100 shown in FIGS. 1 and 2. The package 100 typically comprises meat or other food products placed upon a tray which is to be wrapped in stretchable film for attractive display. The package 100 is placed on a feed-in tray 102 and a package feed-in pusher 104 advances the package into the machine where it is supported and carried forward by one of three circulating platforms 106 which are comprised of cylindrical shafts or rods 106A mounted to a conveyor chain.

Figure 2:
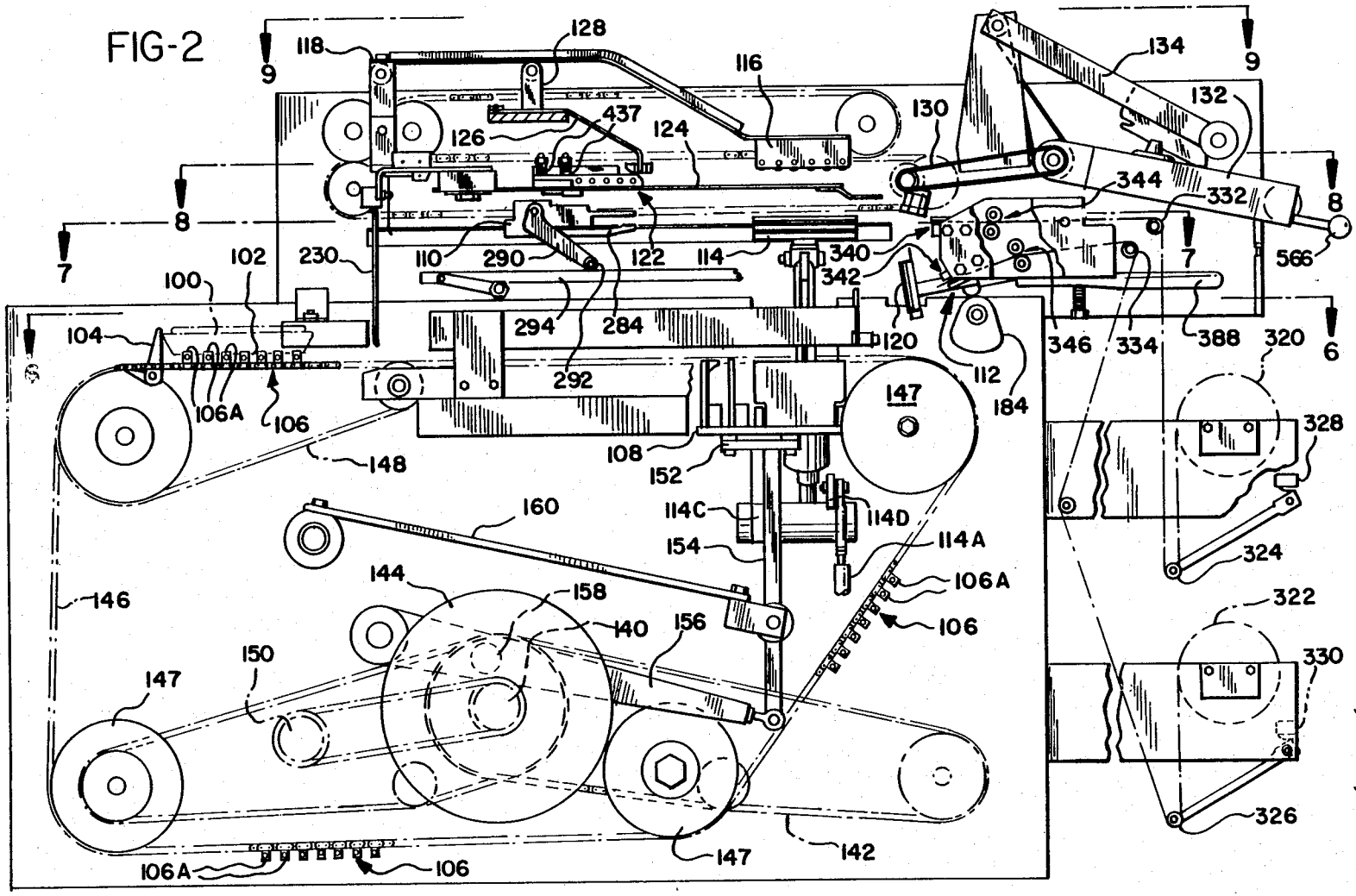
FIG. 2 is a diagrammatic vertical cross-section taken generally along the longitudinal center line of the stretch film wrapping machine of FIG. 1.
Figure 6:
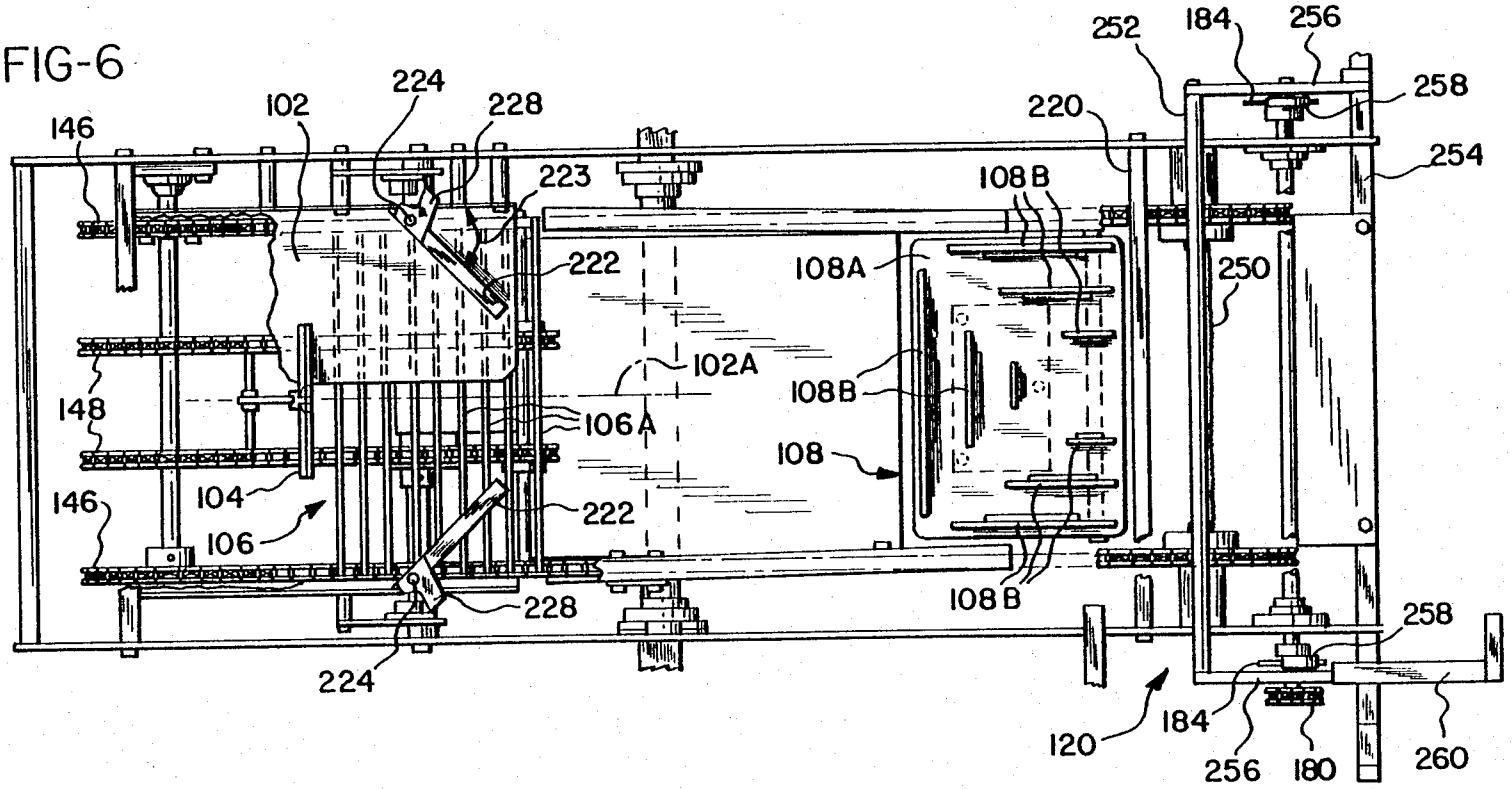
FIGS. 6 through 9 are diagrammatic horizontal cross-sections of the stretch film wrapping machine taken approximately along the corresponding section lines shown in FIG. 2.

The package 100 is carried on one of the platforms 106 to an elevator 108 as best seen in FIGS. 2 and 6. At the same time, a film gripper 110 has been advanced to a film end engaging position 112 where the end of a continuous roll of film is engaged by the gripper 110 and drawn into the machine by retraction of the gripper 110 to the left as shown in FIG. 2. As the package 100 enters the wrapping machine, the length, width and height characteristics of the package are measured so that the length and width of the film to be used to wrap the package can be selected by the machine, as will be described hereinafter.

The section of film drawn into the machine is held in tension by the film gripper 110 and is taken by side clamps 114 which engage opposite sides of the film and stretch it outwardly toward the sides of the film wrapping machine. The package 100 is then elevated on the elevator 108 through the plane of the laterally stretched section of film and engages a package holddown 116. The package holddown 116 is shown in its lowermost position in FIG. 2 and is readily removable from mounting 118. The mounting 118 also permits the holddown to freely pivot upwardly by an amount determined by the height of a package being wrapped.

The section of film drawn into the machine is severed by a knife 120 and the film is folded under the package 100 by a rear underfolder 122 and side underfolders 124 which are activated by the rear underfolder 122. The package 100 with a film section thus underfolded on three sides is pushed out of the film underfolding area of the machine by a package pusher 126. The package pusher 126 includes a cam roller 128 which lifts the package holddown 116 off the package 100 as the pusher 126 is advanced to facilitate ejection of the package from the film underfolding area by the pusher 126.

As the package 100 is pushed from the machine by the package pusher 126, the remaining fourth edge of the film is folded under the package 100 as the package advances onto a conveyor 130. The conveyor 130 transports the wrapped package 100 to the sealing and conveying apparatus 132 where the underfolded film is heat sealed to secure the wrapping of the package 100. To ensure film contact between the package 100 and the sealing/conveying apparatus 132, a pivotally mounted package sealing holddown 134 engages the upper surface of the package 100 and forces or holds it firmly against the sealing/conveying apparatus 132. Thus, articles which are initially placed on a tray as illustrated by the package 100 are wrapped and sealed to form an appealing film covered package for display and sale of the articles.

II. Main Machine Mechanical Drives

Operation of the stretch film wrapping machine will now be described in more detail with further reference to FIG. 2. A main drive shaft 140 is driven by an electric motor (not shown) and a gear reduction drive (not shown) through a chain 142. The main drive shaft 140 includes four machine operating cams with an elevator cam 144 being shown in FIG. 2. The main drive shaft 140 also drives a chain 146 around sprockets 147 and, in turn, the platforms 106 which are positioned equidistant from one another and connected to the chain 146. The package feed-in pusher 104 is mounted to a chain 148 which is driven by the chain 146. The chain 148 is one-third of the length of the chain 146 so that each time the package feed-in pusher 104 is advanced into the feed-in tray 102, a platform 106 precedes and is synchronized with it.

The main drive shaft 140 also drives a potentiometer 150 from which a system clock is derived. The operation of the system clock in the control of the wrapping machine will be fully described hereinafter.

The elevator 108 is supported on a platform 152 and is readily removable therefrom for cleaning purposes. The platform 152 is supported on a shaft 154 which is reciprocated in the vertical direction by a pivotally mounted elevator control arm 156 by means of the elevator cam 144 which engages a cam follower 158. A pivotally mounted stabilizing arm 160 is connected to the shaft 154 to maintain the shaft 154 in a generally vertical orientation throughout its reciprocating motions.

Figure 3:
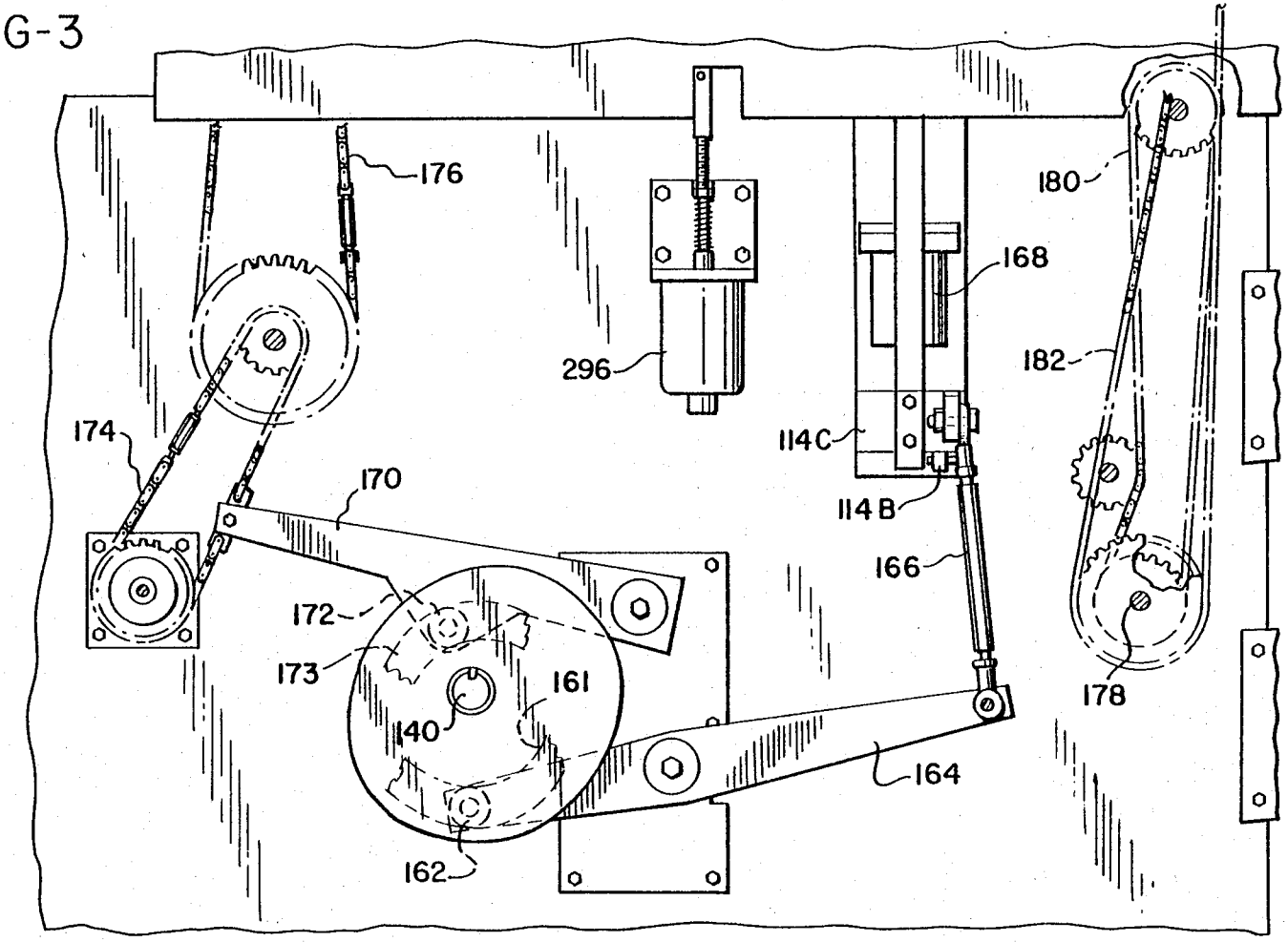
FIG. 3 shows the lower right side of the wrapping machine of FIG. 1 with the cover panels removed.
Figure 7:
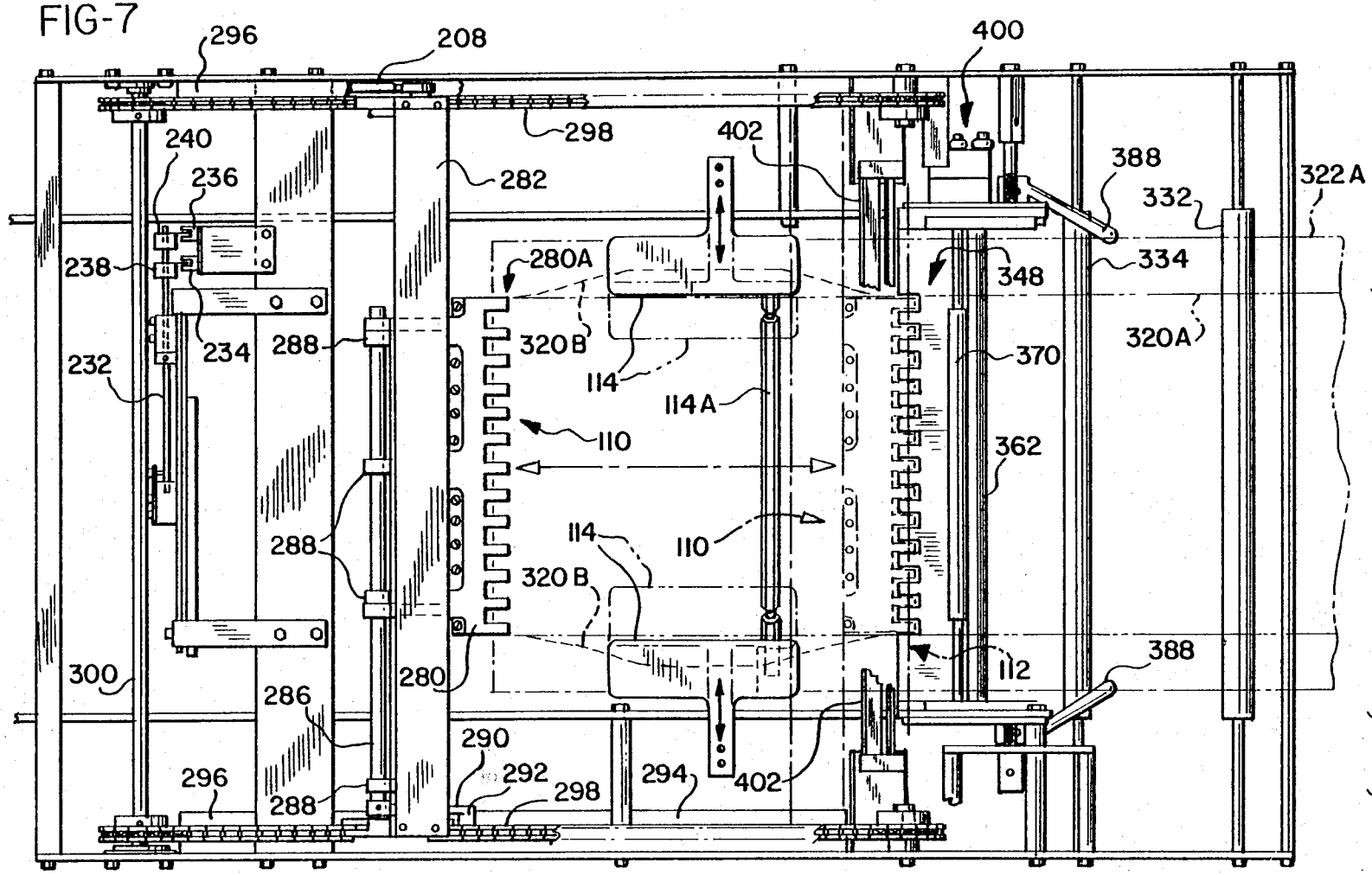

FIG. 3 shows the right side of the wrapping machine as shown in FIG. 1 and includes two additional cam surfaces to control the film clamps 114 and the underfolders 122, 124. A film clamp cam 161 mounted on the drive shaft 140 engages a cam follower 162 and in turn activates a clamp lever arm 164 which reciprocates the side clamps 114 between film engaging and film stretching positions via an adjustable link 166. Film clamping jaws of the film side clamps 114 as best seen in FIGS. 2 and 7 are closed by electrical solenoids 168 as will be described hereinafter.

The underfolders 122, 124 are operated via a pivotally mounted lever arm 170 which includes a cam follower 172 which is driven by a cam 173 mounted on the main drive shaft 140. The lever arm 170 reciprocates a chain 174 which in turn reciprocates an underfolder drive chain 176, see also FIG. 8. Finally, a shaft 178 is driven via a chain (not shown) from the main drive shaft 140 to drive continuously chains 180 and 182. The chain 180 drives cams 184 shown in FIGS. 2 and 6 which activate the film severing knife 120 while the chain 182 drives the conveyor 130, the sealing and conveying apparatus 132, as well as conveying belts included on the sealing holddown 134, as will be described hereinafter.

III. Film Length Selection Mechanism

Figure 4:
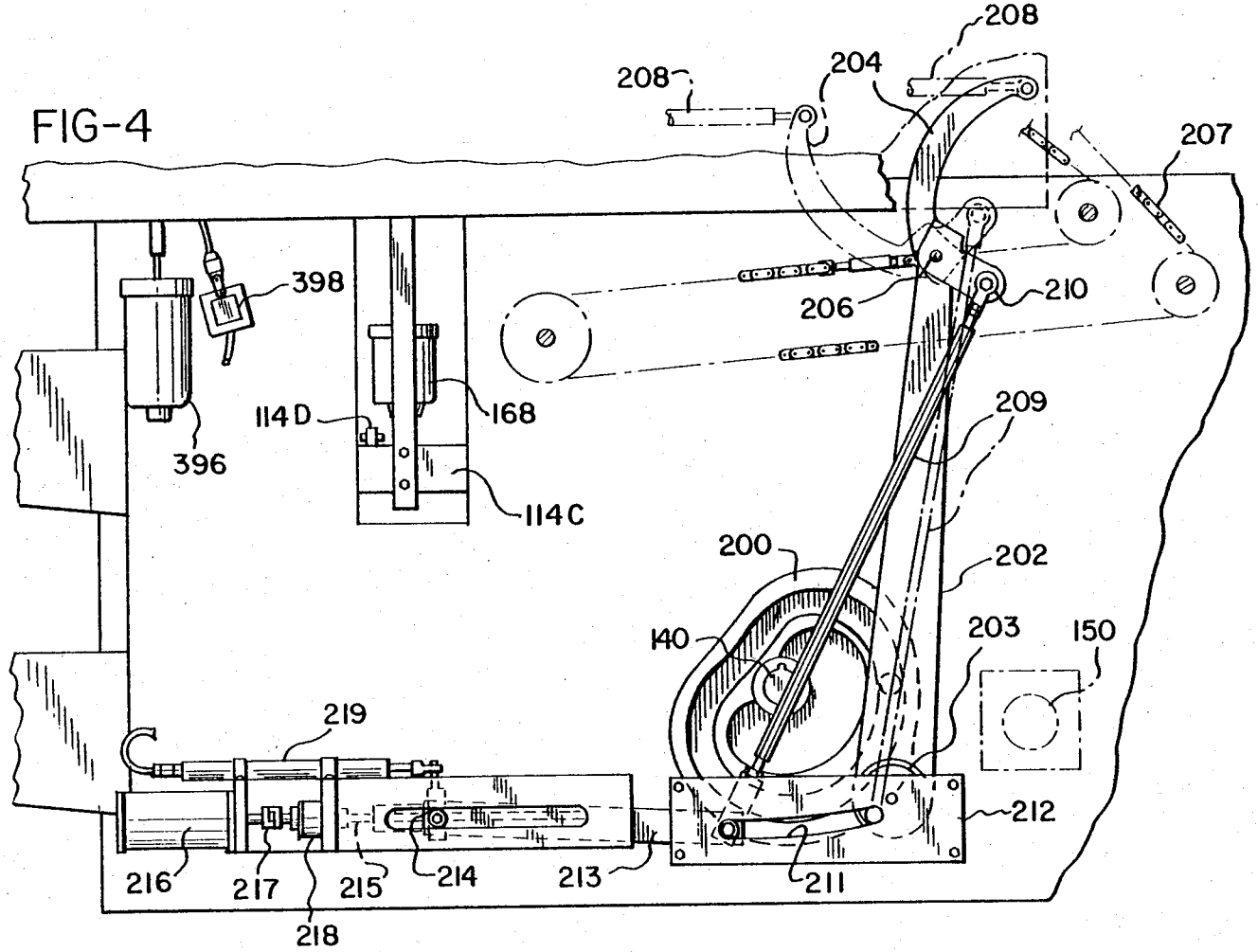
FIG. 4 and 5 show the lower left side of the stretch film wrapping machine of FIG. 1 with the cover panels removed to expose the novel film length selection mechanism of the wrapping machine.
Figure 5:
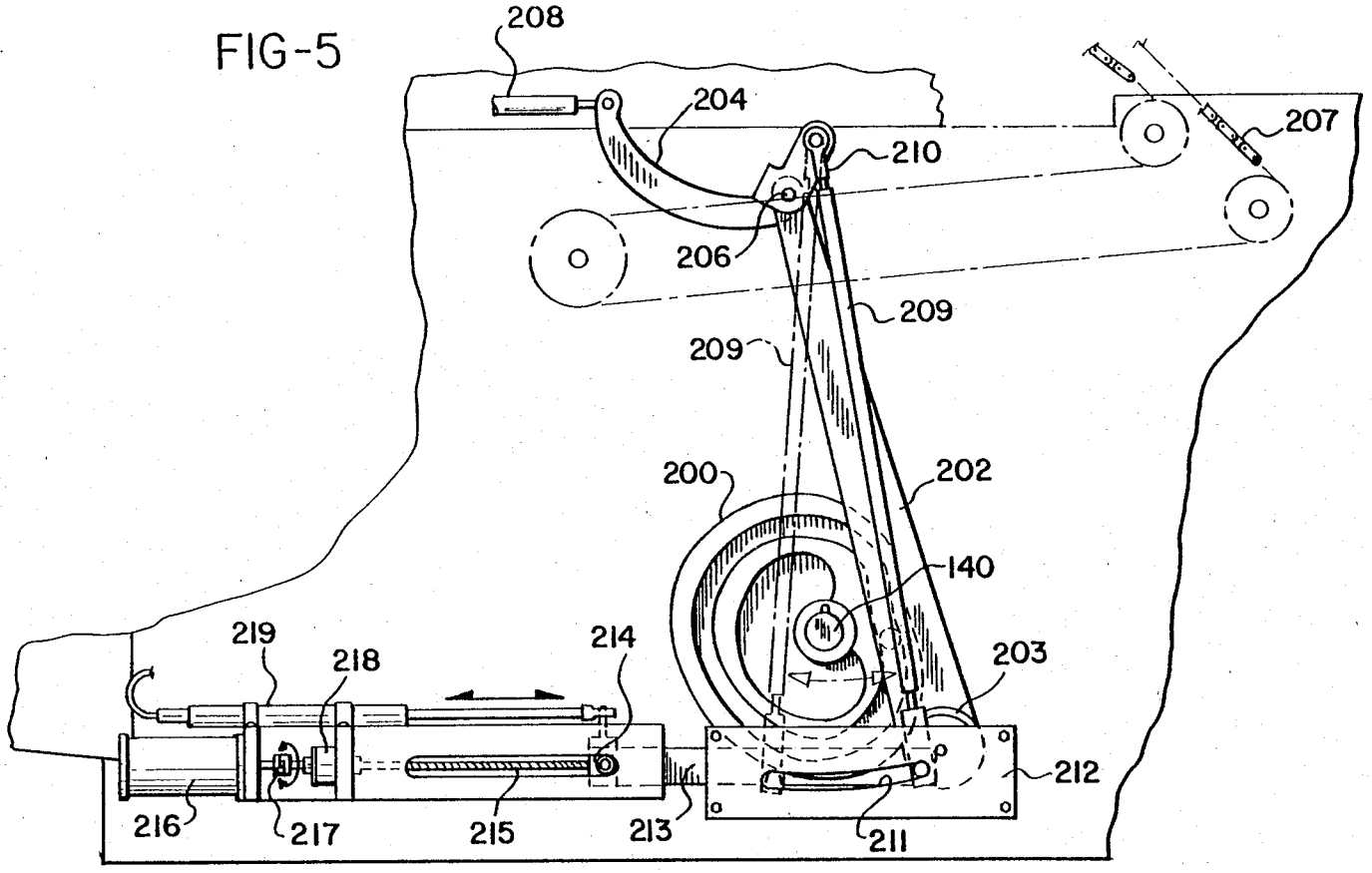

FIGS. 4 and 5 show the left side of the machine as shown in FIG. 1 and illustate the novel mechanism for selecting the length of film sections drawn or pulled into the film wrapping machine by the gripper 110. The main drive shaft 140 is connected to a cam 200 which reciprocates output lever arm 202 approximately between the positions shown in FIGS. 4 and 5. The output lever arm 202 is pivotally mounted to the wrapping machine by a bearing 203. An adjustable lever arm 204, taking the form of a crank in the illustrative embodiment of FIGS. 4 and 5, is pivotally mounted to the distal end of the output lever arm 202 by a pin 206. The pin 206 is connected to a chain 207 to couple the output lever arm 202 to the chain 207 which drives the package pusher 126 through a fixed stroke.

One end of the adjustable lever arm 204 is coupled to the gripper 110 by a link 208 and the other end of the adjustable lever arm 204 is connected to a link 209 by a universal coupler 210. The opposite end of the link 209 is slidingly engaged within an arcuate slot 211 formed within an adjustment guide plate 212 which is mounted to the wrapping machine. The adjustable link 209 can be continuously adjusted to any position along the arcuate slot 211.

The lower end of the link 209 is positioned along the arcuate slot 211 by a bar 213 which engages the lower end of the link 209 and a threaded member 214 which is in turn threadedly engaged by a screw shaft 215. A motor 216 is coupled to the screw shaft 215 through a strain relief clutch mechanism 217. The screw shaft 215 can be secured against rotation by an electrically activated brake 218 which selectively secures or releases the screw shaft 215. A linear potentiometer 219 is coupled to the threaded member 214 and monitors the position of the threaded member 214 so that the control system of the wrapping machine can determine the adjustment of the lower end of the link 209 within the arcuate slot 211 to thereby monitor the setting of the length of film to be drawn for wrapping a package as will be described hereinafter.

The operation of the novel film length selection mechanism can now be described with reference to FIGS. 4 and 5. The solid line drawing of the link 209 near the left end of the arcuate slot 211 provides for maximum articulation of the adjustable lever arm 204 when the output lever arm 202 is moved to the gripper extension position shown in FIG. 4. This articulation can be reduced by moving the lower end of the link 209 to the right as shown in FIGS. 4 and 5 in the arcuate slot 211 to a minimum film length position (shown in phantom in FIG. 4), i.e., near the extreme right end of the arcuate slot 211. Thus, a continuous adjustment of the film extension position of the film gripper 110 is provided between the solid line position and the phantom line position shown in FIG. 4. The extreme left hand and right hand positions of the link 209 within the slot 211 respectively correspond to the maximum and minimum lengths of film to be drawn into the machine for wrapping a package.

The ability to select a variety of film extension positions is important but is only one aspect of a viable film length selection mechanism. It must be remembered that the film gripper 110 must always be moved initially to a fixed film end engaging position 112 determined by film feeding jaws so that a film end may be gripped. To this end, the arcuate slot 211 is centered upon the point of connection of the link 209 with the adjustable lever arm 204 when the lever arm 202 is in the forward, film end engaging position shown in FIG. 5. Thus, for all the continuously variable positions of the lower end of the link 209 within the arcuate slot 211, the forward position or film end engaging position of the gripper 110 is the same. The repeated return of the film gripper 110 to the fixed film end engaging position 112, regardless of the film extension setting of the film gripper, is illustrated in FIG. 5. The lower end of the link 209 can be positioned to any film extension setting between and including the maximum and minimum settings defined by the end points of the arcuate slot 211 with no effect on the positioning of the adjustable lever arm 204 when the output lever arm 202 is in the film end engaging position shown in FIG. 5.

In accordance with the novel film length selection mechanism shown in FIGS. 4 and 5, the length of film to be drawn into the wrapping machine is set by positioning the lower end of the link 209 to a desired position within the arcuate slot 211. Once set, a film length can be maintained indefinitely to reciprocate the film gripper 110 between the fixed film end engaging position 112 and a selected film extension position to thereby draw a preferred length of film for wrapping a plurality of packages of the same size.

IV. Package Handling

FIG. 6 is the first of a series of sectional plan views showing additional details of the wrapping machine of FIG. 1. The series of sectional plan views progress from the package feed-in level upwardly through the machine much as a package to be wrapped passes through the wrapping machine. Structures located at various levels of the machine as identified in FIG. 2 are illustrated in the drawings. For clarity sake and ease of description, features associated with levels of the machine illustrated in other drawings as well as structural detail unnecessary for an understanding of the machine have been deleted. Accordingly, the sectional plan view of FIG. 6 shows the level of the package feed-in tray 102 and the package supporting level of the elevator 108.

IV.A. Package Feed-In

An operator of the wrapping machine places a package to be wrapped on the feed-in tray 102. Preferably the package is placed near the central portion of the feed-in tray 102 and ideally the package should be aligned approximately on the centerline 102A of the feed-in tray. A package thus placed on the feed-in tray 102 is engaged by the package feed-in pusher 104 which is continuously circulated on the chains 148. The package feed-in pusher 104 is preceded by and synchronized with one of the conveyor platforms 106 each of which comprises a plurality of individual rods 106A attached to and circulating with the chains 146 as previously described.

The platform 106 which precedes the package feed-in pusher 104 is positioned immediately below the feed-in tray 102. As the package is pushed off the feed-in tray 102 by the package feed-in pusher 104, the platform 106 receives and supports the package and transports it to the elevator 108. At the elevator 108, a stop 220 engages and restrains the package and permits the platform 106 to be moved from beneath the package. The package is then supported on the upper package supporting surface of the elevator 108.

The elevator 108 comprises a base platform 108A and a plurality of hingedly mounted slats 108B which are resiliently biased toward the upright position, for example, by a plurality of springs (not shown), to receive and support packages placed thereon. This structure of the elevator 108 permits the underfolders 122, 124 to collapse the elevator slats 108B and transfer support of a package to the underfolders 122, 124 as film is folded about the package as is well known in the art.

As a package to be wrapped is pushed across the feed-in tray 102 and onto a platform 106, the package length, width and height are determined by an improved package sensing system included in the disclosed wrapping machine.

IV.B. Package Sensing System

Figure 10:
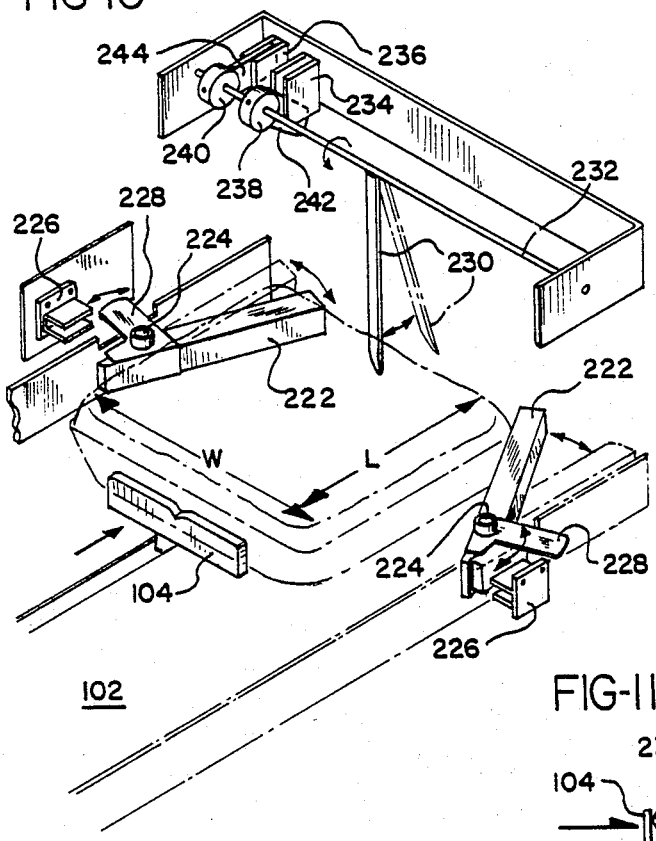
FIGS. 10 and 11 are schematic views of the novel package sensing system of the stretch film wrapping machine.
Figure 11:
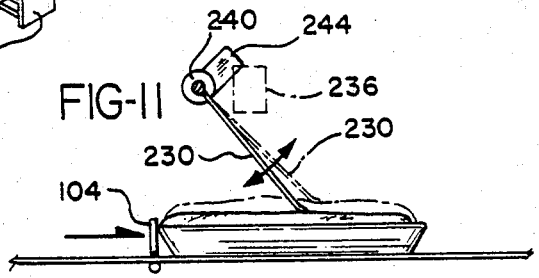

Portions of the improved package sensing system are shown in FIGS. 1, 2, 6 and 7, however, the structure and operation of the system are best understood by referring to the schematic views of FIGS. 10 and 11. With reference to the dimensions of packages which are sensed, herein the length (L) of a package refers to the dimension of the package in the longitudinal direction of the wrapping machine. The width (W) of the package refers to the dimension of the package perpendicular to the line of movement of the package into the machine, see FIG. 10. Accordingly, the width of a package being wrapped by the wrapping machine is normally longer than the length of the package.

In the improved package sensing system, lateral sensing means for sensing the width of packages comprises swing arms 222 which are mounted for pivotal movement on pins 224 on either side of the feed-in tray 102. The swing arms 222 are resiliently biased by springs (not shown) encircling the pins 224 or otherwise to force the swing arms 222 to extend into the package entryway above the feed-in tray 102. The swing arms 222 are inclined into the wrapping machine at an angle 223, see FIG. 6, of approximately 45° and maintained at that angle by mechanical contact between the swing arms 222 and the wrapping machine. The resiliency of the springs biasing the swing arms 222 into the package entryway of the machine is sufficient to permit the swing arms 222 to be deflected by entering packages yet tends to center packages within the entryway to the machine. The angular orientation of the swing arms 222 promotes the tendency of the swing arms 222 to center packages within the entryway of the machine, however, it is noted that an angular orientation of up to approximately 90° would be possible for the swing arm extension into the entryway.

Narrow packages to be wrapped by the machine may pass between the swing arms 222 without deflecting either swing arm. If a narrow package is placed off center on the feed-in tray 102, one of the swing arms 222 may be deflected and tend to force the package toward the center of the feed-in tray. When a wide package is placed on the feed-in tray, both swing arms 222 are deflected by the package as it passes into the wrapping machine. Deflections of the swing arms 222 by packages entering the wrapping machine are detected by electrical switches coupled to the swing arms 222.

In the preferred embodiment of the package sensing system, Hall effect switches 226 are utilized. Hall effect switches prevent contact bounce which may be encountered in other designs of electrical switches and can lead to erroneous package signals. Such Hall effect switches are activated by vanes 228 and are well known in the art and commercially available, for example, from Micro Switch, a division of the Honeywell Corporation, as a Type 4AV vane switch.

The provision of lateral sensing means on both sides of the package entryway essentially eliminates the possibility of erroneously indicating a narrow package as being a wide package since both sensing means must be simultaneously activated for a wide package indication. In the preferred embodiment, both swing arms 222 must be deflected before a wide package is indicated. As illustrated, a single switch is coupled to each lateral sensing means. It is noted that a wide variety of package widths could be sensed by the use of multiple switches as well as other sensing arrangements which include sensors on both sides of the package entryway. Of course, the use of the preferred swing arms 222 has the additional advantage of tending to center packages as they enter the wrapping machine.

Longitudinal sensing means are provided for sensing the length of a package as it is fed into the wrapping machine. The longitudinal sensing means comprises a lever arm 230, best seen in FIGS. 2, 10 and 11, which is firmly affixed to a pivotally mounted cylindrical shaft 232. The lever arm 230 extends downwardly in a generally vertical direction into the package entryway. Two Hall effect switches 234 and 236 are coupled to the shaft 232 through adjustable collars 238 and 240 which include vanes 242 and 244 for activating the Hall effect switches 234 and 236 in accordance with the rotational orientation of the shaft 232. Here again, Hall effect switches are used to prevent contact bounce which may lead to erroneous readings. The Hall effect switch 234 generates a signal immediately upon contact of a package with the lever arm 230 as the package is being pushed into the machine by the feed-in package pusher 104. This signal is used to determine the length of the package entering the machine as will be described hereinafter.

The Hall effect switch 236 is utilized to determine the height of a package entering the machine. As best seen in FIG. 11, the deflection of the lever arm 230 by a package entering the machine is determined by the height of the package. By adjusting the orientation of the vane 244 relative to the switch 236, a high package signal is generated for packages which are above a defined height. Of course, additional switches could be incorporated into the disclosed package sensing system to detect a variety of package heights. The length, width and height signals generated by the improved packaging sensing system are utilized to select the length and the width of a section of stretchable film to be utilized to wrap the particular sensed package. One particular selection algorithm will be described hereinafter.

The knife 120 is also shown in FIG. 6 and includes a serrated blade 250 secured to a cutter bar 252 which is mounted for reciprocating pivotal movement about a shaft 254 by arms 256. The cutter bar 252 and associated serrated blade 250 are reciprocated by the cams 184 which drive cam followers 258 which are connected to the arms 256. The knife 120 can also be manually operated by a handle 260 connected to one of the arms 256.

IV.C. Film Side Clamps and Gripper

FIG. 7 illustrates the next level progressing upwardly through the film wrapping machine and includes a plan view of the length and height sensing apparatus as just described with reference to FIGS. 10 and 11. Also included is the film gripper 110 which draws sections of film into the machine. The film gripper 110 reciprocates between the fixed film end engaging position 112 as represented by the dashed line drawing of the gripper 110 and one of a plurality of film extension positions shown by the solid line drawing of the film gripper 110. The length of the reciprocating stroke of the film gripper 110 is controlled by the novel mechanism illustrated in FIGS. 4 and 5 as previously described.

The film gripper 110 comprises a fixed upper jaw 280 which is securely mounted to a trolley bar 282. A lower gripper jaw 284, as best seen in FIG. 2, is mounted for pivotal movement toward and away from the fixed upper jaw 280. The lower gripper jaw 284 is firmly mounted to a trunnion shaft 286 which is mounted for rotation to the trolley bar 282 through circular members 288 which are firmly fixed to the trolley bar 282. A lever arm 290 is mounted to the trunnion shaft 286 for selectively opening and closing the lower gripper jaw 284 against the fixed upper jaw 280.

The lever arm 290 includes a roller end 292 which engages a movable track 294. The track 294 is mechanically coupled to the right sidewall of the machine by links to maintain the track in a generally horizontal position as it is moved up and down by a solenoid 296 shown in FIG. 3. When the track 294 is elevated, the lever arm 290 is lifted to rotate and close the lower gripper jaw 284 against the fixed upper jaw 280. The roller end 292 of the lever arm 290 permits the film gripper 110 to be moved between the fixed film end engaging position 112 and the variable film extension position. The trolley bar 282 rides on guide rails 296 mounted on both sides of the machine and is propelled by the novel film length selection mechanism shown in FIGS. 4 and 5 through the link 208. The trolley bar 282 is maintained in the orientation shown throughout its reciprocating travel by chains 298 which are interconnected through a rotating shaft 300.

IV.D. Film Handling Apparatus

The disclosed film wrapping machine is designed to provide a choice between two differing film widths for wrapping a variety of package sizes. The film for wrapping packages is provided on continuous rolls as shown in FIG. 2 with the upper roll 320 being arbitrarily designated as the narrow width film 320A and the lower roll of film 322 being arbitrarily designated as the wide width film 322A. Film widths usable in the disclosed film wrapping machine range between approximately thirteen (13) and nineteen (19) inches.

Film from the continuous rolls of film 320 and 322 is fed under tensioning rollers 324 and 326, respectively, in a manner known in the art. In particular, the associated film is fed under each tensioning roller so that the roller assembly is elevated as film is drawn into and used by the wrapping machine. As the roller assembly is raised, a brake is removed from the roll of film so that it can freely rotate and feed additional film which is taken up by the associated tensioning roller as it falls to a lower position where it once again functions to apply the brake to the film roll.

Although such operation of tensioning or "dancing" rollers is well known in the art of film wrapping machines, electrical switches 328 and 330 have been added to the known structure to monitor the tensioning rollers 324 and 326, respectively. The dancing rollers 324 and 326 are adjusted so that they are raised to a minimum height which opens one or the other of the switches 328 and 330 each time film is drawn into the machine. The adjustment of the dancing rollers is based on the minimum length of film drawn into the machine to ensure that one of the switches 328, 330 is opened if film is drawn into the machine. If the film is exhausted from a film roll, breaks or otherwise becomes disengaged from film feeding apparatus during machine operation, film will not be drawn into the machine and the associated switch will not be opened by the dancing roller. The failure of the switch to open is detected to indicate a film problem and the machine is stopped as will be described hereinafter.

The continuous film from the rolls 320 and 322 is fed under the tensioning rollers 324 and 326, up over guide rollers 332 and 334 and into the selective film feeding apparatus shown at the film end engaging position 112. The guide rollers 332 and 334 include one-way clutches to be freely rotatable in the counter-clockwise direction as shown in FIG. 2. The rollers 332 and 334, hence, permit the film to be freely drawn into the machine through the film feeding apparatus, but retard its tendency to be withdrawn from the machine by the dancing rollers.

The film feeding apparatus comprises two sets of film feeding jaws 340 and 342. The film feeding apparatus can be seen in FIGS. 2, 7, 12, 13 and 14. The film feeding jaws are associated with pinch rollers 344 and 346, respectively, with the film being threaded between the pinch rollers and the jaws so that the film may be gripped by the film gripper 110 at the film end engaging position 112. The film feeding jaws 340 and 342 have serrated leading edges 348 which mate with a serrated leading edge 280A of the gripper 110 when the gripper 110 is moved to the film end engaging position 112. Thus, with the film extending to the front edge of the film feeding jaws 340 and 342, the teeth of the serrated edge 280A of the film gripper 110 can engage the film between the teeth of the serrated leading edge 348 of one of the sets of film feeding jaws 340 and 342.

The film feeding jaws 340, 342 and associated pinch rollers 344, 346 extend between end plates 350 which are mounted between the sidewalls of the wrapping machine to pivot about the point 352. The end plates 350 are placed into one position to feed narrow film through film feeding jaws 340 as shown by the solid line drawing in FIG. 14. To feed wide film through film feeding jaws 342, the side plates 350 are pivoted about the point 352 to a second position shown by the dot-dashed line drawing of FIG. 14.

The film feeding jaws 340 and 342 each comprises a fixed jaw 354. The upper film feeding jaws 340 have the lower jaw fixed while the lower film feeding jaws 342 have the upper jaw fixed. The movable jaw 356 of the upper film feeding jaws 340 can be pivoted upwardly away from the upper fixed jaw 354 while the movable jaw 358 of the lower film feeding jaws 342 can be pivoted downwardly away from the lower fixed jaw 354.

Figure 12:
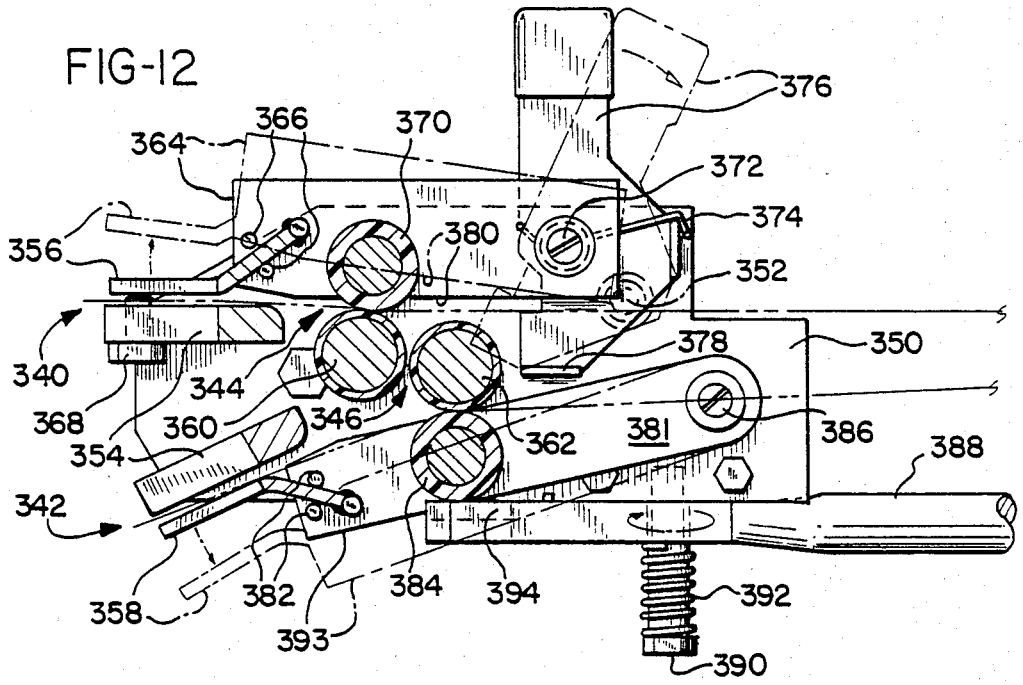
Figure 14:
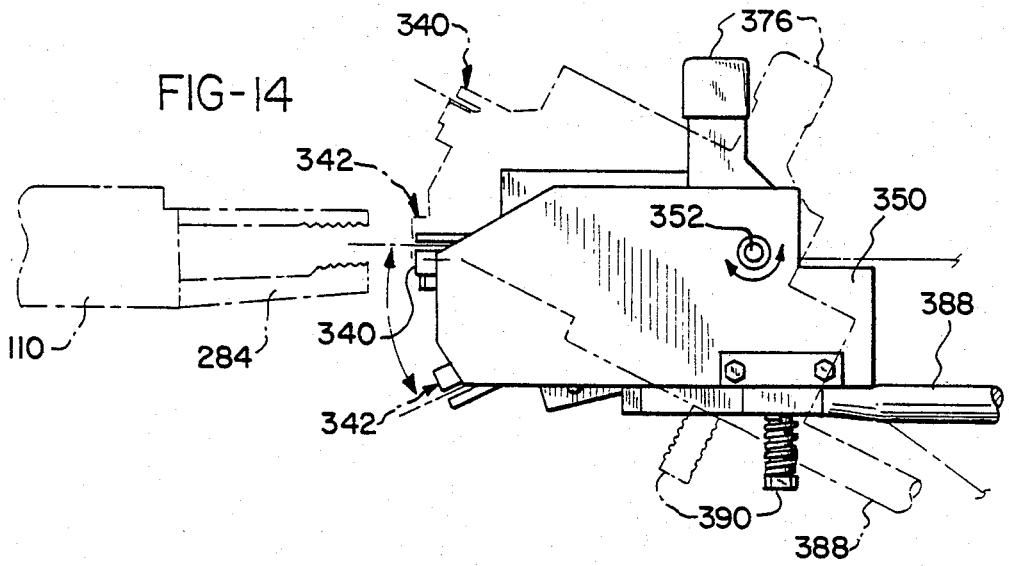

Two fixed rollers 360 and 362 are mounted for rotation between the end plates 350. The movable jaw 356 is pivotally mounted between arms 364 and the pivotal motion of the movable jaw 356 relative to the arms 364 is limited by pins 366. When the upper jaw 356 is in the closed solid line position shown in FIG. 12, a predetermined close film feeding separation is maintained between the movable jaw 356 and the upper fixed jaw 354 by a bolt 368. A roller 370 is also mounted between the arms 364. The roller 370 is coated with rubber or other film gripping material and includes a one-way clutch to allow rotation only in the clockwise direction as shown in FIG. 12. The arms 364 are mounted to be pivoted about screws 372.

During machine operation, the film feeding jaws 340 and associated pinch rollers 344 are maintained in their closed position as shown by the solid line drawing in FIG. 12 by springs 374 which extend between each arm 364 and an associated lever arm 376. The lever arms 376 bias the springs 374 to maintain the arms 364 in the closed position. To thread film into the upper film feeding jaws 340, the lever arms 376 are rotated clockwise to the dotted line position shown in FIG. 12. As the lever arms 376 are rotated, tension is relieved from the springs 374. Also, tabs 378 engage the lower surfaces 380 of the arms 364 to lift the arms 364 and open the jaws 340 and separate the pinch rollers 344. Detents (not shown) on the lever arms 376 and the end plates 350 maintain the lever arms 376 in the closed and opened positions which are thereby stably determined. Once placed in the opened position, narrow film can be readily fed between the pinch rollers 344 and the upper film feeding jaws 340 using both hands.

The lower film feeding jaws 342 are also mounted to open for film threading purposes. The movable jaw 358 is pivotally mounted between arms 381 with the pivotal movement of the jaw being limited by pins 382. A roller 384 which comprises the second of the pinch rollers 346 is mounted between the arms 381. The roller 384 is covered with rubber or other film gripping material and includes a one-way clutch which permits the roller 384 to rotate only in the counter-clockwise direction as shown in FIG. 12. The arms 381 are mounted for pivotal movement about a screw 386.

Due to the fact that the arms 381 tend to move under the force of gravity toward the opened position, a more substantial closing apparatus is provided to maintain the jaws 342 and the pinch rollers 346 in the closed, film feeding position, shown by the solid line drawing in FIG. 12. Lever arms 388 are mounted to rotate about bolts 390 and are spring loaded against the end plates 350 by springs 392. The lever arms 388 can be rotated between a jaws closed position shown by the solid line drawing in FIG. 13 and a jaws opened position shown by the dotted line drawing in FIG. 13. A cam surface 394 engages the lower surface 393 of the arms 381, once they have been manually raised by a machine operator, to fully close and lock the lower jaws 342 and the pinch rollers 346 into the closed, film feeding position.

Detents (now shown) on the lever arms 388 and the end plates 350 similarly serve to define the jaws opened and jaws closed positions of the lever arms 388. As with the jaws 340, when the film feeding jaws 342 and pinch rollers 346 are opened, wide film can be conveniently threaded between and spread across the film feeding jaws 342 and the pinch rollers 346 using both hands. The jaws and pinch rollers can then be closed by manually raising the arms 381 and closing the lever arms 388.

Figure 13:
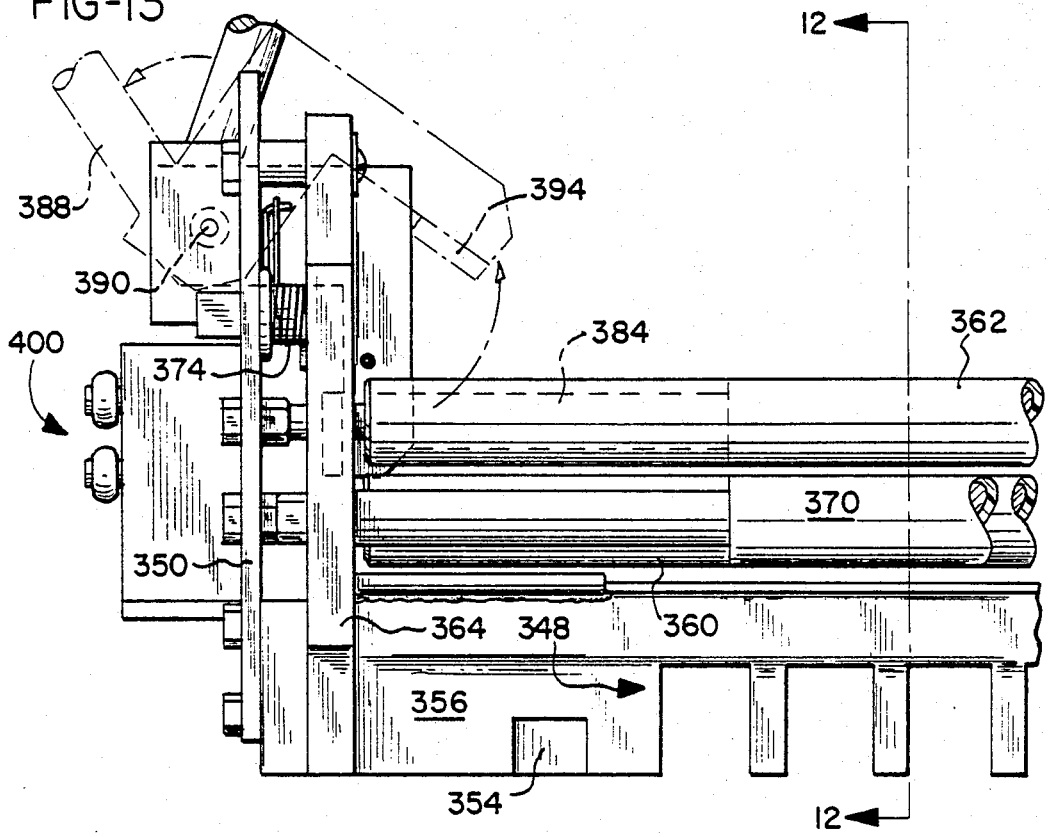
FIGS. 12 through 14 show the novel film feeding apparatus embodied in the disclosed stretch film wrapping machine (see drawing sheets 11 and 12).

The film feeding apparatus is rotated about the pivot point 352 by two solenoids 396 and 398, shown in FIG. 4. The solenoid 396 pushes the film feeding apparatus into the upper, wide film feeding position and the solenoid 398 pulls the film feeding apparatus into the lower, narrow film feeding position. Due to the mass of the film feeding apparatus, the solenoid 396 is larger than the solenoid 398 which is aided by the gravitational tendency of the film feeding apparatus to assume the narrow film feeding position. The connection of the solenoids 396 and 398 to the film feeding apparatus is best seen in FIGS. 7 and 13 at 400.

FIG. 7 also shows the side clamps 114 which engage opposite sides of a film sheet which has been drawn into the machine by the gripper 110 and stretch it outwardly toward the sides of the film wrapping machine. Stretching of the narrow width film 320A is generally illustrated by the dashed stretched film lines 320B in FIG. 7. The film clamps 114 are shown in their inserted position by the dashed line drawing and in their extended, stretching position by the solid line drawing. The side clamps 114 are reciprocated between the inserted and extended positions as previously described with reference to FIG. 3. A link 114A extends from a tab 114B below the hinged mounting 114C of the side clamp mounted in the right hand side of the machine as shown in FIG. 3, and extends to a tab 114D located above the hinged mounting 114C of the side clamp mounted in the left hand side of the machine as shown in FIGS. 2 and 4. The link 114A thus causes the film clamps 114 to move inwardly and outwardly in synchronism with one another.

Finally, an upper cutter bar 402 is shown in FIG. 7. The upper cutter bar 402 receives the serrated blade 250 to cut the selected lengths of film from the rolls 320, 322 when the knife 120 is elevated by the cam 184 and clamps the film end for cutting during the side and rear underfolding operation. Film clamping is performed by an elongated spring clip (not shown) which extends across the cutter bar 252.

IV.E. Film Underfolders

Figure 8:
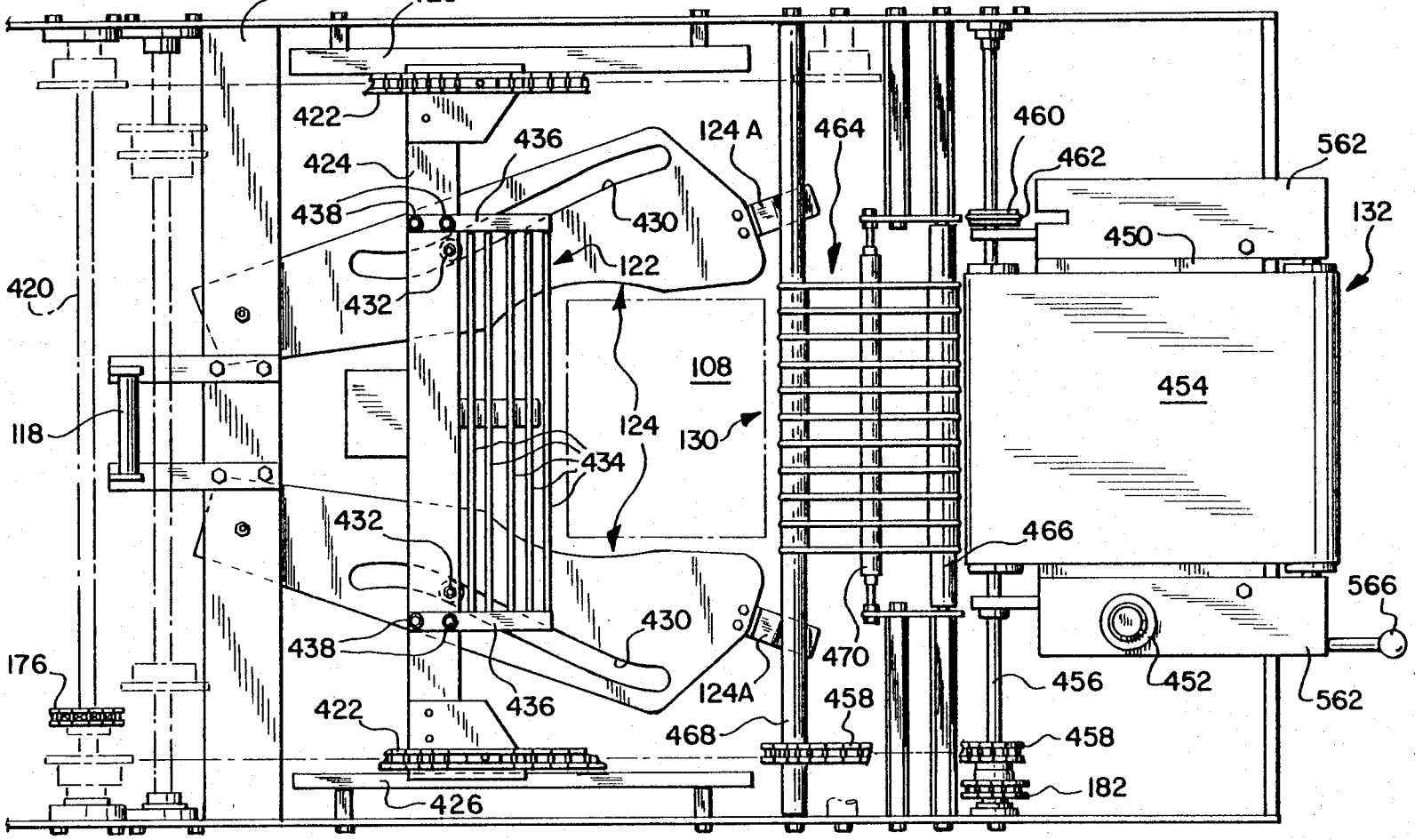

FIG. 8 illustrates the next level progressing upwardly through the machine and includes a plan view of the underfolders 122, 124, the conveyor 130 and the sealing-/conveying apparatus 132. The underfolders 122, 124 are driven by the chain 176 as described with reference to FIG. 3. The chain 176 drives a shaft 420 which in turn drives underfolder drive chains 422 which are connected to a trolley bar 424. The trolley bar 424 rides on guide rails 426 connected to the sides of the wrapping machine.

The side underfolders 124 include angular extensions 124A and are pivotally mounted to a support bar 428 extending between the sides of the wrapping machine. A curvilinear cam surface 430 is formed into each of the side underfolders 124. Each cam surface 430 receives a cam driver 432, each of which is firmly connected to and moves with the trolley bar 424. Thus, as the trolley bar 424 is moved toward the conveyor 130 to force the rear underfolder 122 under a package, the side underfolders 124 are simultaneously pivoted inwardly. Thus, film is folded under three sides of a package by the simultaneous action of the rear underfolder 122 and the side underfolders 124. As the side underfolders 124 are pivoted inwardly, the extensions 124A tuck in the sides of the leading film edge before the leading film edge is folded under the package by being pushed onto the conveyor 130 by the package pusher 126.

The rear underfolder 122 comprises a plurality of rods 434 which are mounted between support arms 436 with each of the rods 434 being freely rotatable within the side arms 436. The side support arms 436 are spring mounted to the trolley bar 424 by compression springs 437 (see FIG. 2) which encircle bolts 438 so that the support arms 436 are resiliently forced against the trolley bar 424. This mounting arrangement for the support arms 436 permits the rear underfolder 122 to be moved away from the trolley bar 424 to facilitate the removal of package jams which may occur between the rear underfolder 122 and the side underfolders 124, the conveyor 130 or other parts of the wrapping machine.

IV.F. Film Sealing and Conveying Apparatus

The sealing/conveying apparatus 132 comprises a heating pad 450 and a continuous conveyor belt 454. The temperature of the heating pad 450 is adjustable via a temperature control which is adjusted by rotating a knob 452. The conveyor belt 454 is carried over the heating pad 450 by a shaft 456 which is driven by the chain 182 as described with reference to FIG. 3. The shaft 456 also drives the conveyor 130 through a chain 458 and the package sealing holddown 134 via a pulley 460 and a "crossed" belt 462 shown in FIGS. 17 and 18. The belt 462 is crossed so that the conveyor 454 and the holddown 134 are rotated counter to one another to complement each other in conveying packages from the machine over the heating pad 450. The sealing/conveying apparatus 132 is pivotally mounted to the shaft 456.

The conveyor 130 comprises a plurality of belts 464 which are mounted between a rotating shaft 466 and a shaft 468 which is driven by the chain 458. The shafts 466 and 468 include grooves for receiving the belts 464. A freely rotating roller 470 is mounted within the belts 464 to support the upper portion of the belts if they are depressed by packages being conveyed by the conveyor 130.

Figure 9:
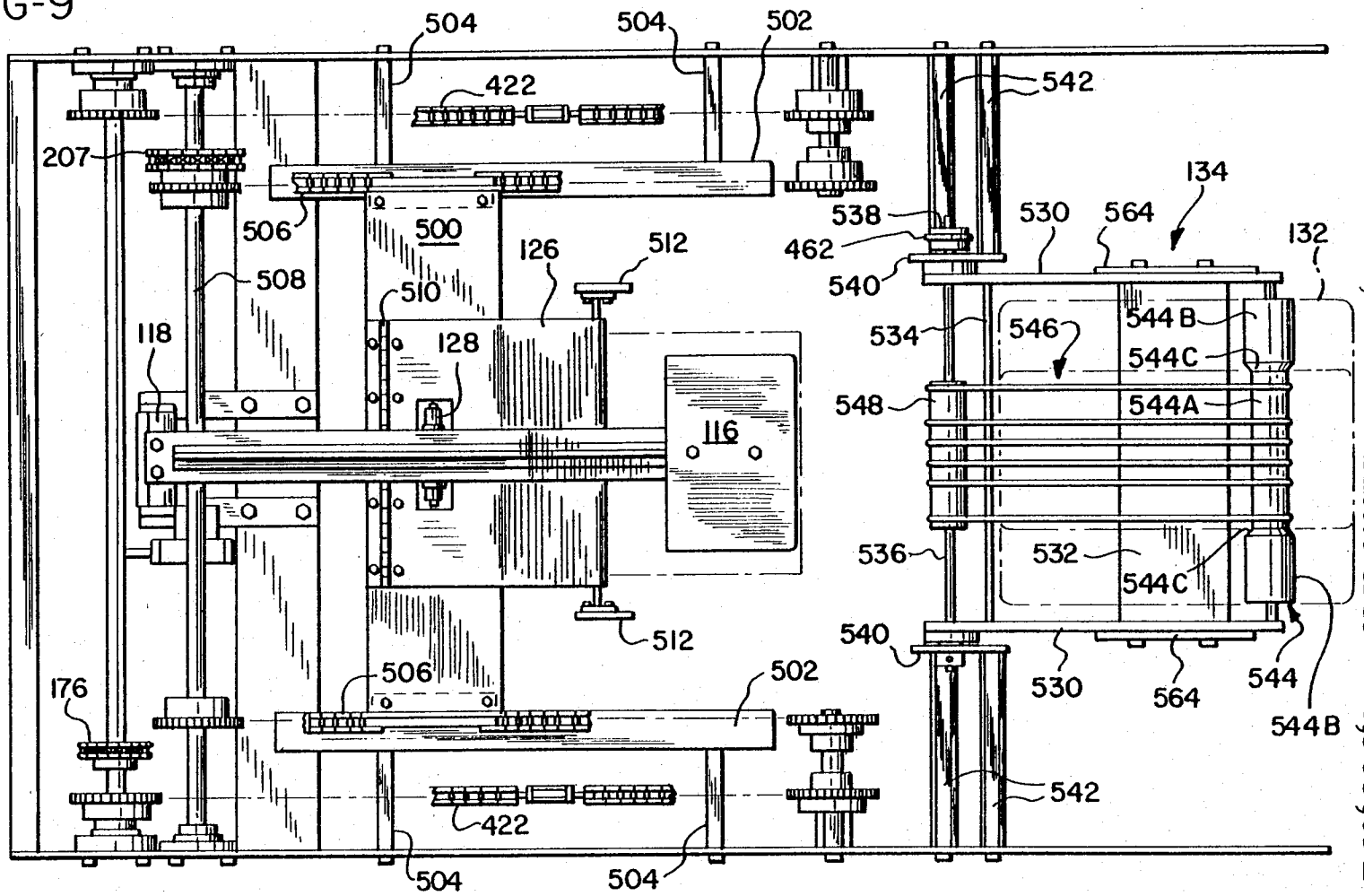

FIG. 9 illustrates the next level progressing upwardly through the film wrapping machine and includes a plan view of the package holddown 116, the package pusher 126 and the pivotally mounted package sealing holddown 134. The package holddown 116 is positioned over the elevator 108 and provides a downward force on packages while film is folded under them by the underfolders 122, 124. The package holddown 116 is pivotally mounted at 118 and can be easily removed from the mounting 118 to provide access into the central portion of the machine.

The package pusher 126 is hingedly mounted to a trolley bar 500 which rides on rails 502 secured to the sidewalls of the wrapping machine through spacers 504. The trolley bar 500 is connected to chains 506 which are driven through a shaft 508 by the chain 207 as previously described with reference to FIGS. 4 and 5. The cam roller 128 is mounted to the trolley bar 500 for lifting the package holddown 116 off packages as the pusher 126 pushes them onto the conveyor 130 and thereby completes the wrapping of packages by underfolding the leading film edge.

The package pusher 126 is mounted to the trolley bar 500 by a hinge 510. The hinge 510 permits the package pusher 126 to be elevated together with the rear underfolder 122 to remove jammed packages from the machine. Lifter blocks 512 are provided on either side of the pusher 126 to prevent the pusher 126 from jamming against or impeding the upward motion of the rear underfolder 122 as it is lifted. The lifter blocks 512 also serve to lift the pusher 126 by contact with the rear underfolder 122 as it is lifted.

The package sealing holddown 134 comprises side members 530 which are rigidly interconnected by a web 532 and a cylindrical rod 534 to form a generally rectangular framework, see FIG. 9. The side members 530 are mounted for free pivotal movement about a rotatable cylindrical shaft 536. The shaft 536 is driven by the belt 462 which engages a pulley 538 firmly affixed to the shaft 536 (see also FIGS. 8, 16 and 17). The shaft 536 is mounted for rotation in side frame members 540 which are affixed to the sides of the machine through spacers 542.

A generally cylindrical holddown roller 544 comprises a central section 544A of a first diameter and two outer sections 544B connected to the central section 544A by frustum sections 544C. The generally cylindrical roller 544 is mounted for rotation between the side members 530 and is driven by a plurality of belts 546 from a multiply grooved pulley 548 which is firmly affixed to the shaft 536. The central section 544A of the generally cylindrical roller 544 includes a plurality of grooves for receiving the belts 546. In the illustrative embodiment, the belts 546 have a generally circular cross-section; however, other shapes of drive belts can be incorporated into the novel sealing holddown 134. The pulley 548 is driven in a counter-clockwise direction as viewed from the right side of the machine, as shown in FIG. 1, by the belt 462 to assist the sealer/conveyor apparatus 132 in conveying wrapped packages from the machine (see FIG. 16).

Figure 15:
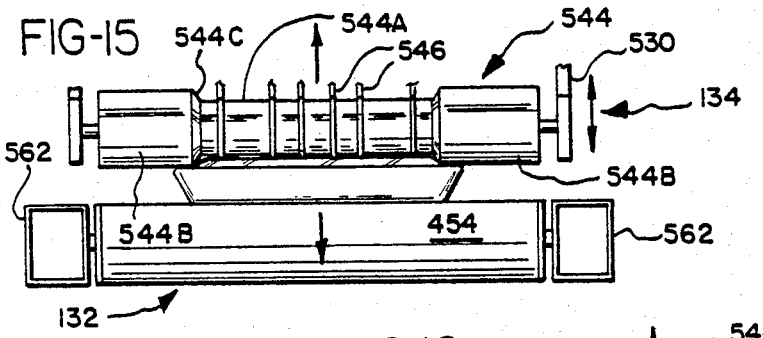
FIGS. 15 and 16 show differing width and height packages passing from the machine (see drawing sheet 10).
Figure 16:
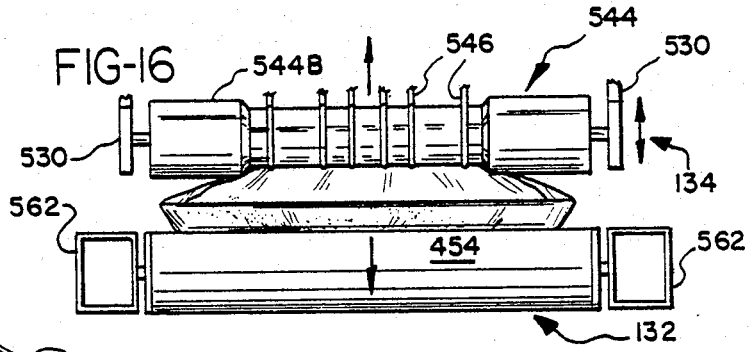

FIGS. 15 and 16 show different width and height packages passing between the sealing/conveying apparatus 132 and the package holddown roller 544. The sealing holddown 134 maintains a force against the top of a package passing across the sealing/conveying apparatus 132 and is rotated by the belts 546 in a direction to complement the conveying action of the sealing/conveying apparatus 132. The sealing holddown 134 is pivotally mounted as previously described so that the holddown can move upwardly as packages pass thereunder. A roller (not shown) comparable to the roller 470 for the conveyor 130 may be mounted within the belts 546 to support the lower portions thereof if the belts are deformed by packages exiting the machine.

The shape of the holddown roller 544 has been found to provide improved sealing contact between wrapped packages and the sealing/conveying apparatus 132. In particular, for thin packages, e.g., steaks or other slices of meat, the outer sections 544B of the roller concentrate the holddown force toward the outer side edges of the tray and may even rest against the upper tray edges, see FIG. 15. Thus, the force is concentrated upon the outer fringe portions of the tray where the majority of the film fold is accumulated and the film fold is then compacted and sealed. For higher packages where such force application cannot be obtained, the roller 544 tends to spread the force laterally across the package and still ensure proper heat sealing of wrapped packages. It is noted that higher packages tend to have more weight and, hence, the force provided by the sealing holddown is less important.

Figure 17:
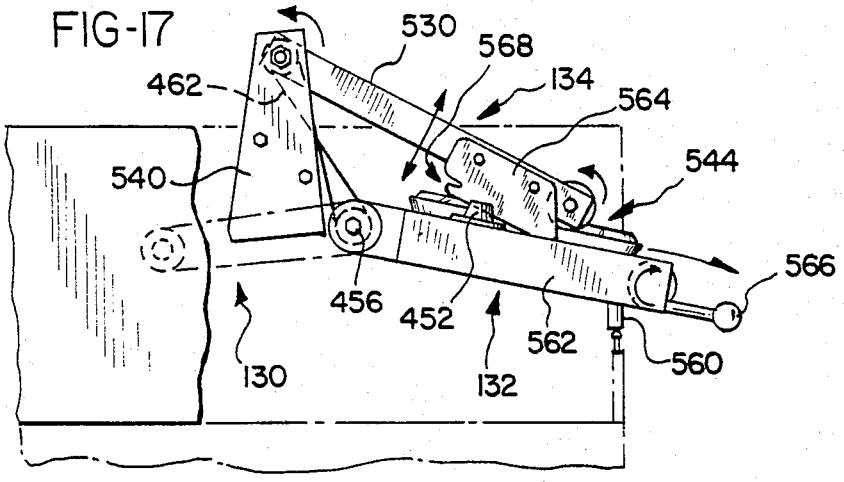
FIGS. 17 and 18 show the cooperative construction of the package holddown and exit conveyor of the stretch film wrapping machine (see drawing sheet 13).
Figure 18:
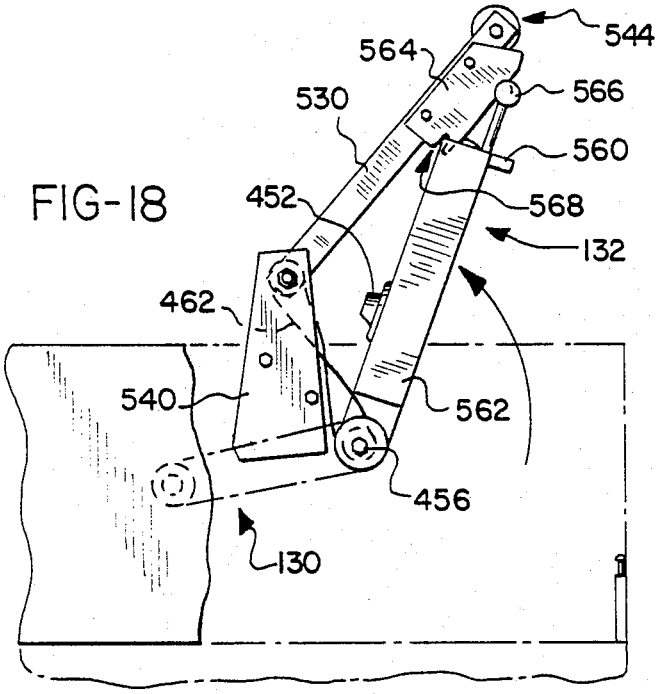

The interrelationship between the sealing/conveying apparatus 132 and the sealing holddown 134 is shown in FIGS. 17 and 18. When in the machine operating, package conveying position, the sealing/conveying apparatus 132 is supported on the wrapping machine frame by an extension 560. In turn, the package sealing holddown 134 is supported on housings 562 by side plates 564 which are constructed from trifluoroethylene, nylon or a similar material.

The film feeding apparatus is oriented generally below the conveyor 130. To make the film feeding apparatus conveniently accessible to an operator for threading film through film feeding jaws 340 and 342 as previously described with reference to FIGS. 12 and 13, the sealing/conveying apparatus 132 is pivoted upwardly by manually lifting a handle 566. The side plates 564 of the sealing holddown 134 are formed to ride against the housings 562 of the sealing/conveying apparatus 132 as that apparatus is pivotally raised from the position shown in FIG. 17 to the position shown in FIG. 18.

A notch 568 is provided in each of the side plates 564 to engage the edges of the housings 562 when the sealing/conveying apparatus 132 is placed into its fully elevated position as shown in FIG. 17. This maintains the sealing/conveying apparatus 132 and the sealing holddown 134 in an elevated position out of the operator's way to provide free access to the film feeding apparatus.

To return the sealing/conveying apparatus 132 and the sealing holddown 134 to the position shown in FIG. 17, a force is applied to the handle 566 to remove the edges of the housings 562 from the notches 568. The sealing holddown 134 is then manually moved away from the sealing/conveying apparatus 132 which is then lowered to a position just below where the edge of the housings 562 will engage the notches 568. At that point, the side plates 564 of the package sealing holddown 134 can again be placed against the sealing/conveying apparatus 132 and both lowered to the position shown in FIG. 17. Thus, a convenient and inexpensive arrangement is provided for moving and locking both the sealing holddown 134 and the sealing/conveying apparatus 132 into an elevated position for free access to the film feeding apparatus.

V. Microprocessor Control System

Figure 21:
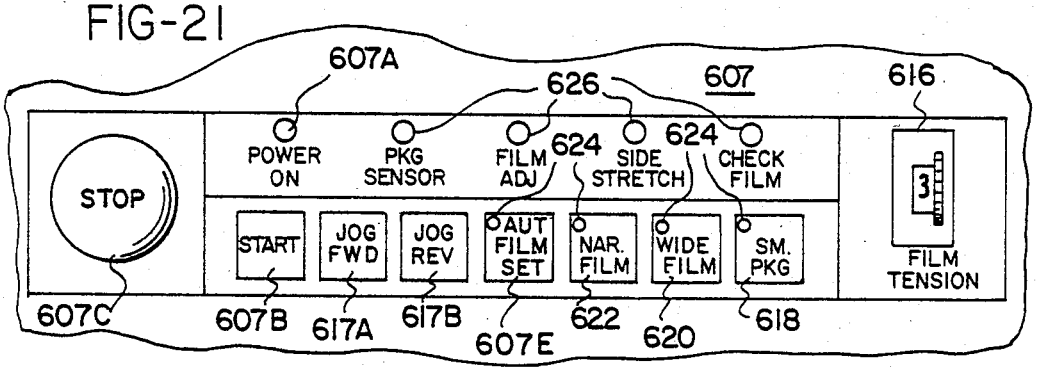
FIG. 21 shows the control panel for the disclosed stretch film wrapping machine (see drawing sheet 12).
Figure 19:
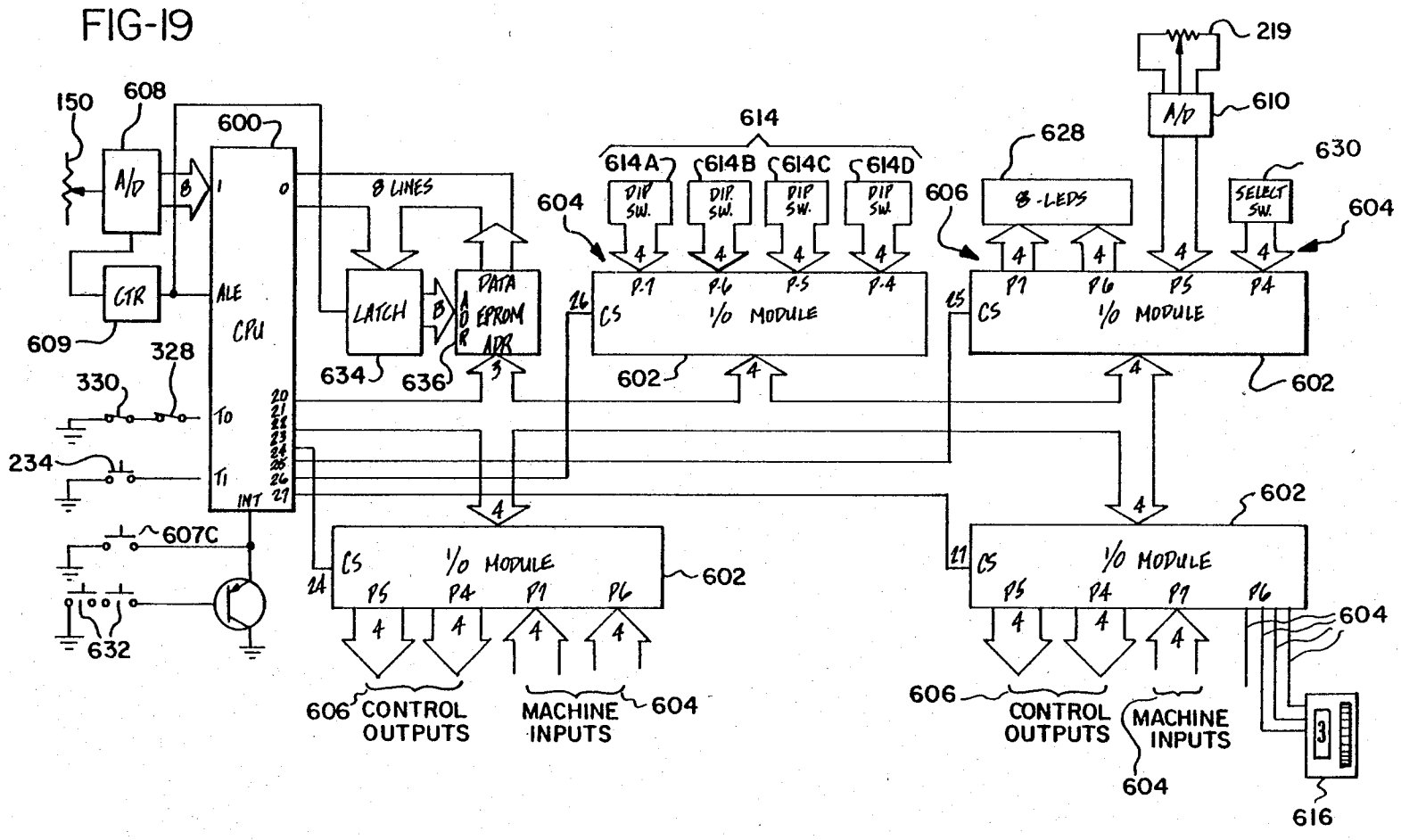
FIG. 19 is a block diagram of the microprocessor control system of the disclosed stretch film wrapping machine (see drawing sheet 14).
Figure 20:
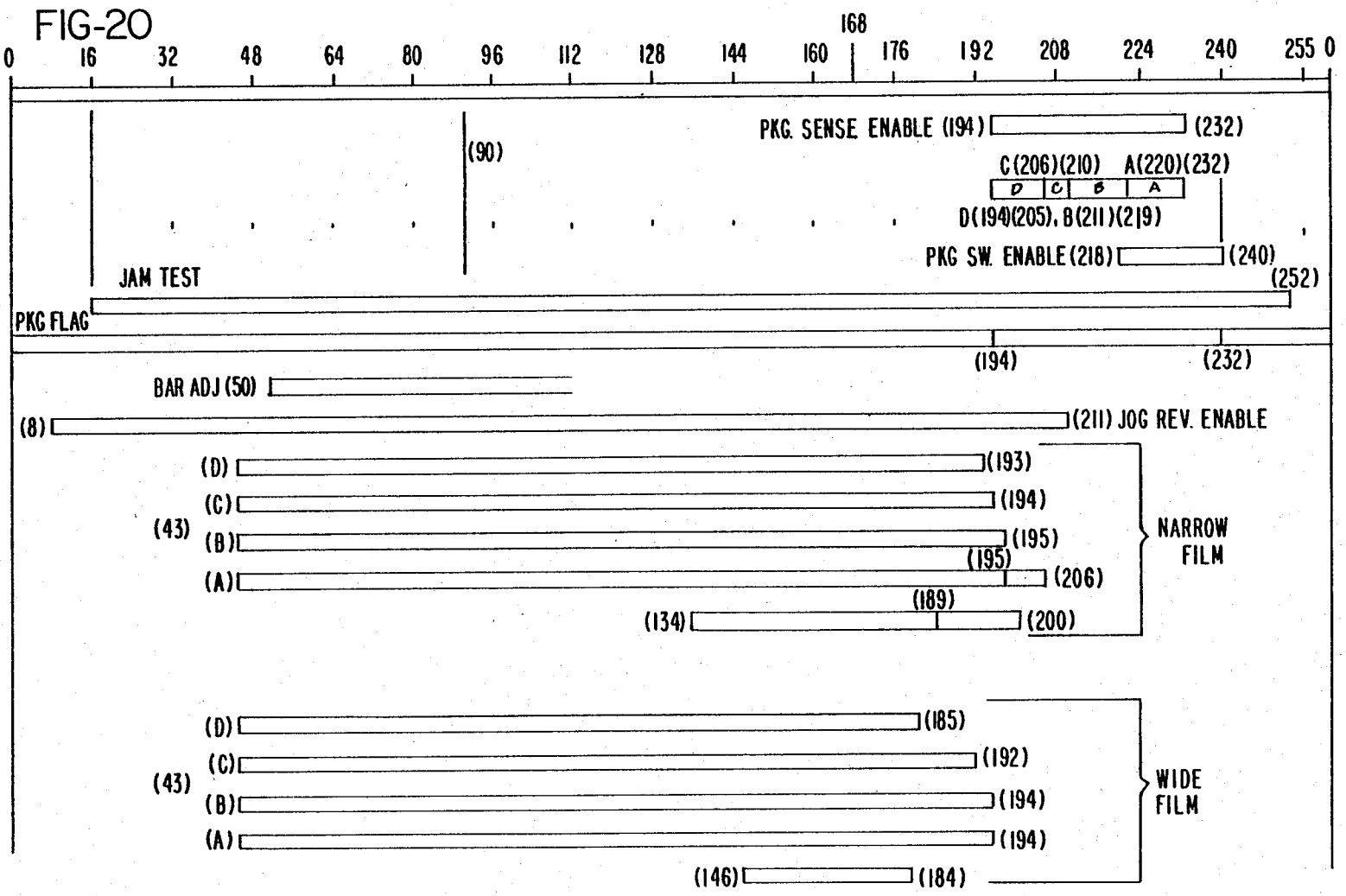
FIG. 20 is a system timing diagram for the microprocessor control system of the stretch film wrapping machine (see drawing sheet 15).

The mechanical operation of the wrapping machine is controlled by the main drive shaft 140 which drives the four control cams 144, 161, 173, 200 and the various chain drives previously described. With reference to FIGS. 19 through 21, the electrical operation of the wrapping machine is controlled by a microprocessor 600 and associated input/output (I/O) modules 602 which monitor and control electrical devices of the machine in synchronism with the main drive shaft 140. Input signals to the microprocessor 600 are received on inputs 604 of the I/O modules 602 and output display and control signals are generated on outputs 606 of the I/O modules 602.

The wrapping machine is controlled and monitored by an operator through a control panel 607 as shown in FIGS. 1 and 21. The various switches and displays, although to some extent self-explanatory due to functional labelling, will be referred to and explained as the control system is described. When the machine is powered up, a "power on" display 607A is lighted by a transformer (not shown). To start the machine, a start switch 607B is depressed and to stop the machine an easily accessible, oversized stop switch 607C is depressed. Activation of the stop switch 607C also provides for emergency stops of the wrapping machine by stopping the machine within a minimum period of time.

Electrical/mechanical coordination is accomplished by the generation of system clock signals from the output signal of the potentiometer 150 which is driven from the main drive shaft 140. The potentiometer 150 generates an analog voltage signal the magnitude of which directly corresponds to the angular orientation of the main drive shaft 140. Hence, the locations of the various machine components are defined by the analog voltage signal throughout each operating cycle of the machine.

The analog voltage signal from the potentiometer 150 is converted into binary coded clock counts by an eight bit analog-to-digital (A/D) converter 608 (see FIG. 19). The A/D converter 608 is driven from the clock of the microprocessor 600 through a divider or counter circuit 609. The eight bit clock counts generated by the A/D converter 604 define 256 distinct operating points for each machine cycle. The clock counts are monitored by the microprocessor 600 to perform required electrical operations upon the occurrence of specific clock counts.

Operation of the microprocessor control system of the wrapping machine can best be understood by referring to the system timing diagram shown in FIG. 20. Clock counts generated by the A/D converter 608 are shown across the top of the system timing diagram. The clock counts and, hence, the operations of the microprocessor control system are synchronized with the mechanical operation of the wrapping machine by setting the clock count of 168 as the point when the package pusher 104 engages a package positioned at the rear-most end 102A of the feed-in tray 102 as shown in FIG. 1.

For a package to be wrapped, a clock count of 194 must be received by the microprocessor 600. Upon receipt of the 194 clock count, the microprocessor 600 initiates sensing of the length, width and height characteristics of a package to be wrapped by enabling the package sensing operation. If an autofilm set switch 607E is operated, the machine automatically selects the width and length of film to be used to wrap each package based on the sensed package size characteristics. During the period of clock counts between and including 194 to 232, the output signal from the Hall effect switch 234 is monitored through an input T1 of the microprocessor 600 to sense whether a package is present and, if present, the length of the package. By reading the clock count when the Hall effect switch 234 is operaed by the contact of an incoming package with the lever arm 230, the package length is determined. The earlier the switch 234 is operated, the longer the package. If no package is sensed, film will not be drawn into the machine for that machine cycle.

Four package sizes or size ranges have been empirically defined for the disclosed film wrapping machine: D (the largest package size) is defined by actuation of the Hall effect switch 234 between and including clock counts of 194 to 205; C, between and including clock counts of 206 to 210; B, between and including clock counts of 211 to 219; and A (the smallest package size) between and including clock counts of 220 to 232. Even though a continuous film length selection is possible within the limits of thw novel mechanism shown in FIGS. 4 and 5, four distinct film length settings corresponding to the four defined package sizes have been chosen for use in the disclosed film wrapping machine.

The four film lengths have been found to be satisfactory for wrapping a large variety of package sizes. By utilizing four differing film lengths, the film is efficiently used by the wrapping machine while the number of necessary adjustments of the film length selection mechanism shown in FIGS. 4 and 5 is reduced to provide longer life.

The film wrapping machine is stopped if oversized packages are fed into it. Such oversized packages could potentially lead to jamming and/or contamination of the machine. An oversized package is indicated by actuation of the Hall effect switch 234 prior to a clock count of 194, in which event the machine is stopped prior to the elevation of the elevator 108. The machine stop is performed at a clock count of 90 which ensures that the elevator 108 is not appreciably raised prior to machine shutdown. The elevator 108 is in the down position between clock counts of approximately 28 to 126.

The Hall effect switch 236, as previously described, is controlled from the lever arm 230 to detect the height of packages to be wrapped. Reading of the switch 236 is enabled by the microprocessor 600 between and including clock counts of 218 to 240 to detect the height of packages entering the wrapping machine. If the lever arm 230 is deflected by a package equal to or greater than approximately two and one-half (2½) inches high during this portion of the machine cycle, a flag is set indicating that a high package is coming into the machine. The high package flag is read at a clock count of 240 and thereafter cleared for the next package sensing operation.

If a high package is detected, wide film is selected and the next longer film increment, i.e., the next larger package size is indicated with the exception that if the minimum film length was initially indicated, the minimum film length will still be used. Of course, if the maximum film length was initially indicated, no adjustment will be made beyond that maximum film length which is used to wrap the package.

At a clock count of 228, a wide package test is performed. A wide package is defined as a package approximately nine (9) inches in width or wider, of course, the definition of a wide package is adjustable in the disclosed wrapping machine. A wide package is indicated if both Hall effect switches 226 are activated by deflections of the swing arms 222 by a package entering the wrapping machine. Both switches must be activated since an operator may place a package off-center so that one of the switches 226 may be operated by a narrow package.

If a wide package is sensed, wide film from the roll 322 will be selected at a clock count of 240 by operating the solenoid 396 as previously described. Once a film width has been selected, that the width film continues to be provided to the wrapping machine until the other film width is required in accordance with the characteristics of a package sensed during the package sensing window. The package sensing window extends between clock counts of 194 and 240 and includes the high package test and wide package test.

At a clock count of 252 the microprocessor 600 determines what film length is to be used to wrap the package that was just sensed. The film width to be used was previously determined at a clock count of 240. Film lengths are determined by the sensed package size with the shortest of the four film lengths being drawn for an A size package and incremental increases for B, C and D size packages. Also, as previously noted, if a high package has been detected, the next longer film length will be drawn unless the minimum or maximum film length was indicated.

Once the film length to be used is determined, the present setting of the film length selection mechanism shown in FIGS. 4 and 5 is read from the linear potentiometer 219. If the desired film length and the present setting are the same, no adjustment is necessary; however, if the two are different, the film length selection mechanism must be adjusted to pull the desired length of film.

The linear potentiometer 219 generates an analog output signal which is directly proportional to the positioning of the lower end of the link 209 along the arcuate slot 211. The analog output signal of the linear potentiometer 219 is converted into a four bit binary code by an A/D converter 610 (see FIG. 19). This four bit code defines sixteen different film lengths which could be selected by the microprocessor 600 of the electrical control system for the disclosed wrapping machine. As previously noted, in the disclosed embodiment only four of the available sixteen film lengths are selected. These four film lengths are the same for both of the two different film widths. It is noted that all sixteen film lengths could be selected if desired and also additional lengths could be defined by the use of an analog-to-digital converter having greater than a four bit output signal.

If an adjustment of the film length selection mechanism is necessary, the disc brake 218 which normally locks the screw shaft 215 in an adjusted position, is released; and, if the film length to be drawn is less than the present setting of the film length selection mechanism, a motor reversing relay (not shown) is operated to precondition the motor 216 to operate in the proper direction for the required adjustment.

These preliminary film length adjustment operations are performed at a clock count of 252. The clock count then progresses to 255 and, due to the potentiometer 150 design, there is a time lapse until a zero clock count is generated. During this time lapse the jam test, as will be described, is not performed since a jam condition could be indicated. Fixed clock counts defining points at which operations are to be performed or which are used to calculate such points are also read into the memory of the microprocessor during this time lapse. Reestablishment of these fixed clock counts for each machine cycle ensures their availability and accuracy in the event that they had been inadvertently deleted or altered during the preceding machine cycle.

At a clock count of 16, the jam test is initiated. The jam test is performed by monitoring the clock counts during each operating cycle of the microprocessor 600. The microprocessor operating cycle is short compared to the time (approximately 7 milliseconds) between consecutive clock counts. Monitoring of the clock counts is performed by incrementing an eight (8) bit jam counter for each microprocessor operating cycle and clearing the jam counter for each change of the clock count. The jam counter is maintained within the microprocessor 600 and, hence, is not physically shown in FIG. 19. During smooth operating portions of the film wrapping machine cycle, a count of approximately fourteen microprocessor operating cycles can be anticipated between consecutive clock counts.

A jam condition is indicated if the jam counter overflows as the result of the main drive shaft 140 hesitating for a sufficient period of time. When the motion of the main drive shaft 140 is thus delayed, the position of the potentiometer 150 is similarly delayed and the corresponding clock count does not change, which permits the count in the jam counter to accumulate. Upon the detection of a jam condition, power to the machine motor is interrupted. The jam test is disabled at a clock count of 252 as previously described since the "blank portion" of the potentiometer 150 encountered between clock counts of 255 and 0 could be indicated as a machine jam. The jam test could have been disabled between clock counts of 255 and 0, however, since other operations are performed at clock counts of 252 and 16, these clock counts were chosen for convenience.

The tension of the film on wrapped packages is controlled by setting the operate and release times of the film side clamps 114 and the release times of the film gripper 110 in synchronism with or in phased relation to the underfolders 122, 124. In the improved microprocessor control system used in the disclosed wrapping machine, the operate and release times of the film side clamps 114 correspond to the film width selected and the release times of the film gripper 110 correspond to the film width selected and also to the package length as determined by the package sensing system.

The operate time of the film gripper 110 is the same regardless of the film width or length since the film gripper 110 must always operate when it is in the film end engaging position 112 as shown in phantom view in FIG. 7. Hence, whenever film is drawn into the machine, the film gripper 110 is operated at a clock count of 43 regardless of the length or width of the film to be drawn.

The film side clamps 114 are operated at set clock counts of 134 for narrow film and 146 for wide film. Operation of the film side clamps 114 at a clock count of 134 for the narrow film 320A provides for gripping narrow film when the side clamps are at their innermost position. By delaying operation of the side clamps 114 until a clock count of 146 for the wide film 322A, the side clamps 114 have started their outward movement. Thus, while the wide film 322A is gripped further in from the film side edges than the narrow film, the film clamps 114 are more widely separated from one another when the wide film is gripped. Of course, the exact points of application of the clamps 114 can be adjusted by changing the clock counts at which the clamps are activated.

It should be clear that the longer film is held by the side clamps 114 and the film gripper 110 as the underfolders 122 and 124 operate, the more the film is stretched about a package and, hence, the greaer the tension of the film. The release of the side clamps 114 is set at a base clock count of 189 for narrow film and at a base clock count of 184 for wide film. The base clock counts for the release of the film gripper 110 depend upon both the film width selected and the size of the package being wrapped. For narrow film, the base clock counts for gripper release are: D package size, 193 clock count; C package size, 194 clock count; B package size, 195 clock count; and A package size, 195 clock count. For wide film, the base clock counts for gripper release are as follows: D package size, 185 clock count; C package size, 192 clock count; B package size, 194 clock count; and A package size, 194 clock count.

At a clock count of 43, the actual release clock counts for the side film clamps 114 and the film gripper 110 are calculated from the defined base release clock counts. The actual release clock counts are calculated to permit compensation for mechanical changes which may occur due to wear and aging of the wrapping machine over its operating life. Such changes can effect the synchronization of the underfolders 122, 124 with the release times of the side clamps 114 and the film gripper 110. Also, the film wrapping machine may be operated in a variety of ambient environmental conditions, such as varying temperature and humidity, and also a variety of film gauges may be used in the film wrapping machine.

Compensation for such aging and environmental conditions is provided in the disclosed wrapping machine by adjusting the actual release clock counts for the side film clamps 114 and the film gripper 110 by up to plus or minus seven clock counts from the base clock counts. The adjustments are provided by means of adjustment switches 614. Four separate switches 614A through 614D, are provided to adjust the release time individually for the release of the film clamps for wide film (614B); the release of the film gripper for wide film (614A); the release of the film clamps for narrow film (614D); and the release of the film gripper for narrow film (614C). In addition to the adjustment switches 614, a tension adjustment switch 616 is provided to adjust the base release clock counts of the film gripper 110 by from zero to plus seven clock counts.

The tension control switch 616 is a thumb wheel switch controlled by the operator of the machine. The setting of the switch 616 is used to calculate the gripper release clock counts for both narrow and wide film widths. The settings of the adjustment switches 614 are normally changed only infrequently due to aging or changed ambient conditions with changes typically being made during routine maintenance. Hence, the switches 614 are normally available only to maintenance service personnel and not to the machine operator.

For the side clamps 114, the actual release clock counts are calculated by combining the base release clock counts previously defined and the setting of the corresponding film clamp adjustment switch 614B or 614D. For the film gripper 110, the actual release clock count is calculated by combining the base clock counts previously defined with both the setting of the corresponding wide or narrow film gripper adjustment switch 614A or 614C and the setting of the tension control switch 616.

A package flag is maintained by the microprocessor 600. The package flag is cleared prior to each package sensing window (between and including clock counts of 194 to 232) and remains cleared if no package is sensed. If the package flag is cleared, no film is drawn into the wrapping machine even though the mechanical operation of the machine continues. If a package is sensed during the package sensing window, the package flag is set. If the package flag is set, film is drawn into the machine to wrap the sensed package. The microprocessor 600 maintains a count of the number of consecutive wrapping machine cycles during which the package flag rmains cleared and the wrapping machine is stopped after a programmable number of operations, preferably seven (7) operations.

At a clock count of 50, an adjustment of the film length mechanism shown in FIGS. 4 and 5, if necessary, is initiated by energizing the motor 216. The direction of operation of the motor 216 was previously selected at a clock count of 252 to precondition the adjustment. The linear potentiometer 219 is monitored while the motor 216 operates until the setting of the film length mechanism corresponds to the desired setting. When the setting indicated by the potentiometer 219 and the desired setting are equal, the motor 216 is turned off and the disc brake 218 is activated to secure the screw shaft 215 at the desired setting. Activation of the brake 218 prevents creeping of set adjustments of the film length selection mechanism as well as helping to prevent overshoot as adjustments are made. Limit switches (not shown) prevent the motor from trying to force the lower end of the link 209 beyond the ends of the arcuate slot 211.

The disclosed wrapping machine can be incrementally operated or "jogged" in either a forward direction or in a reverse direction by operation of momentary contact switches 617A and 617B, respectively, see FIG. 21. Forward jog permits the machine to be operated through a complete package wrapping sequence to ensure the machine is properly set up before being operated at full speed. Operation by forward jogging does not provide a well wrapped package since machine inertia is required for smooth, actual wrapping performance. Reverse jog operation facilitates removal of jams from the machine.

The reverse jog can only be activated betweem machine clock counts of 8 and 211 inclusive. The limitation on the reverse jog operation ensures that the machine is not operated in a reverse direction through the portion of mechanical operation where the underfolders 122, 124 fold down the spring loaded slats 108B of the elevator 108. Reverse operation through this portion of the machine cycle could cause damage to the machine. Each activation of one of the jog switches 617A or 617B, provides power to the main machine motor for a time period of one clock count. Although the power is provided for only one clock count, the machine moves through more than one clock count due to the mechanical inertia created by the pulsed activation of the motor.

Special provisions are made for "small packages" which are defined for the disclosed film wrapping machine as being approximately five (5) inches wide by five (5) inches long and below two and one-half (2½) inches high. When a small package switch 618 is activated, only narrow width film is provided to the wrapping machine, the film gripper 110 base release clock count is set to 206 and the side film clamps 114 base release clock count is set to 200. Calculation of the actual release times of the clamps 114 and the gripper 110 are as previously described, but with the modified base release clock counts.

The operator may also select either wide width film or narrow width film regardless of the film width which is indicated by the automatic package sensing system previously described. When a wide film switch 620 is activated, the film selector presents only wide film to the film gripper 110. The film length drawn is still determined by the package sensing system and activation of the height switch, i.e., the Hall effect switch 236, again causes the next longer film length to be pulled, except for minimum or maximum lengths as previously described.

When a narrow film switch 622 is activated, only narrow film is presented to the film gripper 110. The film length drawn is still set in accordance with the package length sensed as previously described again with the exception that if the height switch is activated, the next longest film length is pulled (unless minimun or maximum film length is indicated).

At a clock count of 92, the microprocessor 600 determines whether one of the film sensing switches 328 and 330 was opened due to film being drawn into the film wrapping machine. If no film was drawn, the machine is shut-down. This permits the unwrapped package to be removed from the machine and the film to be refilled or the film problem corrected without contamination to the wrapping machine which could occur if an uncovered package was moved through the wrapping machine.

Advantageously, a machine stop at a clock count of 92 due to a film problem condition may facilitate threading a new roll of film into the machine in the event that the film has expired. Normally, when a roll of film expires, a short section of the trailing end of the film will remain threaded through the corresponding film feed-in jaws 340 or 342. This remaining section of film can be "adhered" to the leading end of the replacement roll of film either by natural adhesion between the two, by tape or otherwise. The new film can then be threaded through the film feeding jaws by pulling the remaining section of film through the jaws from inside the machine. After the film is pulled into the machine and straightened within the corresponding film feeding jaws, the film is severed by manually activating the knife 120 via the handle 260. The machine is then ready to operate once again. Thus, the disclosed wrapping machine provides two convenient and rapid techniques for threading a new roll of film into the wrapping machine.

The control panel 607 of FIG. 21 includes various displays 624 which indicate the active film selection or operating mode of the wrapping machine. Other displays 626 on the control panel 607 indicate operations being performed by the machine. Similarly, operation of the microprocessor 600 can be monitored through a light emitting diode display panel 628, with the specific signal displayed being selected by a display function switch 630 (see FIG. 19). Cover panel interlock switches 632 stop the wrapping machine from being operated if the cover panels are not secured on the machine.

One successful embodiment of the microprocessor control system for the disclosed stretch film wrapping machine has been constructed using the following components:

TABLE I

| | |
|---|---|
| 600 | MICROPROCESSOR, 8035 available from Intel Corporation |
| 602 | I/O MODULE, 8243 available from Intel Corporation |
| 608 | A/D CONVERTER, ADC 0800 available from National Semiconductor Corporation |
| 609 | COUNTER, 4027 available from Motorola Corporation |
| 610 | A/D CONVERTER, ADC 0803 available from National Semiconductor Corporation |
| 634 | I/O PORT, 8212 available from Intel Corporation |
| 636 | ERASABLE PROGRAMABLE READ ONLY MEMORY (EPROM), 2716 available from Intel Corporation |

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In a film wrapping machine including at least a wide roll and a narrow roll of continuous stretchable film, gripper means for drawing a section of one of said rolls of film into said machine, means for selectively presenting any one of said rolls of film to said gripper means, and means for controlling the stroke of said gripper means to determine the length of said section of film drawn into said machine, an improved package sensing and film control system comprising:

lateral sensing means for generating a wide package signal and a narrow package signal representative of the width of a package entering said machine;

longitudinal sensing means for generating signals representative of the length of a package entering said machine;

vertical sensing means for generating a low package signal and a high package signal representative of the height of a package entering said machine; and control means responsive to said length signals, said width signals and said height signals for controlling said presenting means and said gripper controlling means to select both the width and length of the section of stretchable film drawn into said machine said control means interpreting said length signals as being one of a plurality of package lengths and responding to said package size signals to present the narrow film roll to said gripper means unless a wide package signal or a high package signal is received, in which case the wide film roll is presented and for controlling said gripper controlling means to draw the length of film indicated by said length sensing means with the next longer film length being drawn if a high package signal is received unless the maximum or minimum film length was initially indicated.

2. In a film wrapping machine including control means for selecting both the width and the length of a section of stretchable film drawn from one of at least two differing width continuous rolls of such film in response to signals characteristic of a package to be wrapped, an improved package sensing system for generating said signals comprising:

lateral sensing means for sensing the width of a package as it is fed into the machine and comprising:

first sensing means on one side of the package entryway to the machine; and second sensing means on the opposite side of the package entryway to the machine whereby narrow packages to be wrapped will engage neither or one of said first and second sensing means and wide packages will engage both of said first and second sensing means upon entering the machine;

longitudinal sensing means for sensing the length of a package as it is fed into the machine; and vertical sensing means for sensing the height of a package as it is fed into the machine to determine whether the height of a package is less than or greater than a predetermined height, said control means basing the length of said film section on the sensed length of a package unless said predetermined height is exceeded in which case the length of said film section is increased.

3. The improved package sensing system of claim 2 wherein said first and second sensing means each comprises at least one electrical switch.

4. The improved package sensing system of claim 3 wherein said lateral sensing means assists in centering packages entering the machine and said first and second sensing means each comprises:

a pivotally mounted swing arm extending into the package entryway to the machine;

means coupling said swing arm to at least one electrical switch; and resilient means for biasing said swing arm into the package entryway, said resilient means being of sufficient resiliency to yield under the force on an entering package yet exert a force tending to center entering packages between said swing arms.

5. The improved package sensing system of claim 4 wherein said pivotally mounted swing arms are slanted into the entryway of the machine.

6. The improved package sensing system of claim 2, 3, 4 or 5 wherein said longitudinal sensing means comprises a lever arm pivotally mounted above the package entryway to the machine and extending in a generally vertical direction downwardly into said package entryway, and at least one electrical switch coupled to said lever arm so that a signal is generated upon contact of said lever arm by an entering package.

7. The improved sensing system of claim 6 wherein said vertical sensing means comprises at least one electrical switch coupled to said lever arm for generating height signals which define the deflection of said lever arm by packages entering said machine and thereby the height of said packages.

8. The improved sensing system of claim 7 wherein said electrical switches comprise Hall effect switches whereby contact bounce leading to inaccurate signals is eliminated.

9. In a film wrapping machine including at least two differing width rolls of continuous stretchable film, gripper means for drawing a section of one of said rolls of film into said machine, means for selectively presenting any one of said rolls of film to said gripper means, and means for controlling the stroke of said gripper means to determine the length of said section of film drawn into said machine, an improved package sensing and film control system comprising:

lateral sensing means for generating signals representative of the width of a package entering said machine;

longitudinal sensing means for generating signals representative of the length of a package entering said machine;

vertical sensing means for generating signals representative of the height of a package entering said machine to determine whether the height of a package exceeds a predetermined height; and control means responsive to said length signals, said width signals and said height signals for controlling said presenting means and said gripper controlling means to select both the width and length of the section of stretchable film drawn into said machine, the length of said film section being based on said length signals, unless said predetermined height is exceeded, in which case, the length of said film section is increased.

10. In a film wrapping machine including a source of continuous stretchable film, gripper means for drawing a section of said film into said machine, and film length selection means for setting the stroke of said gripper means to determine the length of said film section, an improved package sensing and film control system comprising:

longitudinal sensing means for measuring the length of a package entering said machine;

vertical sensing means for measuring the height of a package entering said machine to determine whether the package is higher than a predetermined height dimension; and control means for monitoring said longitudinal and vertical sensing means and for controlling said film length selection means to draw one of a plurality of film lengths in accordance with the measured package length for packages which do not exceed said predetermined height dimension and to draw the next longer film length for packages which do exceed said predetermined height dimension.

11. The improved package sensing and film control system of claim 10 wherein said film source comprises two film supplies, one of a width for wrapping a package having a height which does not exceed said predetermined height dimension and the other of a greater width for wrapping a package having a height which exceeds said predetermined height dimension, said film control system further comprising:

film feeding means for positioning the leading edges of either of said film supplies into a position to be engaged by said gripper means; and wherein said control means further comprises film selection means for controlling said film feeding means in accordance with the measured height of said package, whereby both the appropriate width and length of film to wrap a package are selected in accordance with the sensed package height.

12. The improved package sensing and film control system of claim 11 further comprising lateral sensing means for measuring the width of a package entering said wrapping machine to determine whether the package is wider than a predetermined width dimension, and wherein said control means monitors said lateral sensing means and said film selection means controls said film feeding means to select the wider of said two film supplies if the measured package width exceeds said predetermined width dimension, whereby film width selection is determined in accordance with both the measured width and height of the package and film length selection is determined in accordance with both the measured length and height of the package.

13. A method of selecting the size of a sheet of wrapping material to be used for wrapping a package comprising the steps of:

transporting the package toward a wrapping station;

measuring the package length as it is being transported;

measuring the package height as it is being transported to determine whether the package height is greater than a predetermined height dimension;

providing a continuous supply of wrapping material wider than said package with a leading edge thereof positioned at a defined material pulling location;

pulling the leading edge of said wrapping material to a first location determined in accordance with the measured length of said package if the measured height of the package does not exceed said predetermined height dimension and to a second location a defined distance beyond said first location if the measured height of the package exceeds said predetermined height dimension.

14. The method of claim 13 wherein two wrapping material supplies are provided, one of a width for wrapping a package having a height which does not exceed said predetermined height dimension and the other of a greater width for wrapping a package having a height which exceeds said predetermined height dimension, and further comprising the steps of:

positioning the leading edges of both material supplies adjacent to said material pulling location and spacing said leading edges apart from one another; and selectively moving one of said leading edges into said material pulling location in accordance with the measured height of said package, whereby both the appropriate material width and length are selected in accordance with the measured package height.

15. The method of claim 14 further comprising the steps of:

measuring the package width as it is being transported to determine whether the package is wider than a predetermined width dimension; and moving the wider of said material supplies into said material pulling location if the measured package width exceeds said predetermined package width, whereby the width of wrapping material is selected in accordance with the measured height and width of the package and the length of wrapping material is selected in accordance with the measured length and height of the package.

16. A method of wrapping a package comprising the steps of:

transporting the package horizontally to an elevator platform;

measuring the package length as it is being transported to said elevator platform;

measuring the package height as it is being transported to said elevator platform to determine whether the height is greater than a predetermined height dimension;

providing a continuous supply of stretch wrapping film wider than said package with a leading edge thereof positioned above said elevator platform at a film pulling location;

pulling the leading edge of the film in a horizontal plane to extend a length of the film over said package;

pulling the leading edge of the film to a first location determined in accordance with the measured length of said package if the measured height of the package does not exceed said predetermined height dimension and to a second location a defined distance beyond said first location if the measured height of the package exceeds said predetermined height dimension;

severing the film from said supply to create a rectangular sheet of said film;

elevating the package into stretching engagement with said sheet;

tucking the former leading edge and the side edges of said sheet beneath said package;

conveying the package from the elevated level to tuck the trailing edge of the sheet beneath said package; and sealing the sheet of film beneath the package to secure the sheet therearound.

17. The method of claim 16 wherein two film supplies are provided, one of a width for wrapping a package having a height which does not exceed said predetermined height dimension and the other of a greater width for wrapping a package having a height which exceeds said predetermined height dimension, and further comprising the steps of:

positioning the leading edges of both film supplies adjacent to said film pulling location and spacing said leading edges apart from one another; and selectively moving one of said leading edges into said film pulling location in accordance with the measured height of said package, whereby both the appropriate width and length of said film sheet are selected in accordance with the package height.

18. The method of claim 17 further comprising the steps of:

measuring the package width as it is being transported to said elevator platform to determine whether the package is wider than a predetermined width dimension; and moving the leading edge of said greater width film into said film pulling location if the measured package width exceeds said predetermined package width, whereby the width of film is selected in accordance with the measured height and width of the package and the length of film is selected in accordance with the measured length and height of the package.

* * * * *

UNITED STATES PATENT AND TRADEMARK OFFICE

CERTIFICATE OF CORRECTION

PATENT NO. : 4,505,092

DATED : March 19, 1985

INVENTOR(S) : Russell E. Bowers; Fritz F. Treiber

It is certified that error appears in the above—identified patent and that said Letters Patent is hereby corrected as shown below:

Abstract, line 6, "active electrical switches" should read --activate electrical switches--.

Col. 5, line 66, "To ensure film contact" should read --To ensure firm contact--.

Col. 18, line 49, "limits of thw novel" should read --limits of the novel--.

Col. 19, line 38, "selected, that the width" should read --selected, that width--.

Col. 21, line 35, "the greaer" should read --the greater--.

Col. 22, line 43, "flag rmains" should read --flag remains--.

Signed and Sealed this

*Twenty-second* Day of *April 1986*

[SEAL]

*Attest:*

DONALD J. QUIGG

*Attesting Officer* *Commissioner of Patents and Trademarks*